US008931815B2

(12) United States Patent
Tang

(10) Patent No.: US 8,931,815 B2
(45) Date of Patent: Jan. 13, 2015

(54) EASILY INSTALLED AND NON-DEFACING SECURITY LATCH

(76) Inventor: Gordon C. Tang, Bellevue, WA (US)

( * ) Notice: Subject to any disclaimer, the term of this patent is extended or adjusted under 35 U.S.C. 154(b) by 1015 days.

(21) Appl. No.: 12/790,629

(22) Filed: May 28, 2010

(65) Prior Publication Data

US 2010/0301619 A1 Dec. 2, 2010

Related U.S. Application Data

(63) Continuation-in-part of application No. 12/778,910, filed on May 12, 2010, now abandoned, which is a continuation-in-part of application No. 12/700,389, filed on Feb. 4, 2010, which is a continuation-in-part of application No. 12/454,383, filed on May 15, 2009, now abandoned.

(51) Int. Cl.

| | |
|---|---|
| ***E05C 19/16*** | (2006.01) |
| ***E05C 17/32*** | (2006.01) |
| ***E05C 17/36*** | (2006.01) |
| ***E05C 17/46*** | (2006.01) |
| ***E05C 19/18*** | (2006.01) |
| ***E05B 51/00*** | (2006.01) |
| *E05B 15/02* | (2006.01) |

(52) U.S. Cl.

CPC ..... *E05C 17/32* (2013.01); *E05C 17/365* (2013.01); *E05C 17/46* (2013.01); *E05C 19/184* (2013.01); *E05B 51/005* (2013.01); *E05B 2015/023* (2013.01)

USPC ..... 292/251.5; 292/262

(58) Field of Classification Search

USPC ..... 292/262–278, 251.5

See application file for complete search history.

(56) References Cited

U.S. PATENT DOCUMENTS

| | | | | |
|---|---|---|---|---|
| 4,042,265 | A * | 8/1977 | Chezem | 292/262 |
| 4,311,330 | A | 1/1982 | Lum | |
| 5,076,624 | A * | 12/1991 | Gotanda | 292/264 |

FOREIGN PATENT DOCUMENTS

| | | |
|---|---|---|
| JP | 01-138075 | 9/1989 |
| JP | 01-154778 | 10/1989 |
| KR | 10-2008-0057157 | 6/2008 |

* cited by examiner

*Primary Examiner* — Mark Williams

(74) *Attorney, Agent, or Firm* — Olympic Patent Works PLLC

(57) ABSTRACT

Embodiments of the present invention include door-securing latches that allow an occupant of a room or other space accessed through a door to secure the door, from inside the room or other space, in order to prevent entry or access by others. Embodiments of the present invention provide a mechanically strong and secure latch that cannot be easily broken or compromised by application of force to the door or by insertion of a tool or device between the door and an adjacent door frame to disable the latch, but that can be disabled by a knowledgeable individual, such as an apartment manger seeking to rescue a disabled apartment occupant in an emergency situation.

16 Claims, 31 Drawing Sheets

EASILY INSTALLED AND NON-DEFACING SECURITY LATCH

CROSS-REFERENCE TO RELATED APPLICATIONS

This application is a continuation-in-part of patent application Ser. No. 12/778,910, filed May 12, 2010 now abandoned, which is a continuation-in-part of patent application Ser. No. 12/700,389, filed Feb. 4, 2010, which is a continuation-in-part of patent application Ser. No. 12/454,383, filed May 15, 2009 now abandoned.

TECHNICAL FIELD

The present invention is related to security and, in particular, to door latches that allow an occupant of a room to secure a door and that are easily installed, without resulting in defacement of the door or door frame, and not easily defeated by application of force to the door or by inserting tools between the door and doorframe.

BACKGROUND OF THE INVENTION

Door locks and latches have been used for millennia. A great many different types of latches and locks have been devised, manufactured, installed, and used over the course of human history. As with any technological art, the design and manufacture of door locks and latches has evolved, over time, to incorporate many new features and ideas. As with any technology, locks and latches that work well in certain circumstances may not be as useful or practical under alternative circumstances, and there is generally always a potential for improving current locks and latches, particularly in the context of specific applications and circumstances.

SUMMARY OF THE INVENTION

Embodiments of the present invention include door-securing latches that allow an occupant of a room or other space accessed through a door to secure the door, from inside the room or other space, in order to prevent entry or access by others. Embodiments of the present invention are designed to satisfy a number of application constraints, including provision of a mechanically strong and secure latch that cannot be easily broken or compromised by application of force to the door or by insertion of a tool or device between the door and an adjacent door frame to disable the latch, but can be disabled by a knowledgeable individual, such as an apartment manger seeking to rescue a disabled apartment occupant in an emergency situation, by straightforward methods that do not result in damage or defacement of the door and/or door frame. Embodiments of the present invention can be installed without defacing the door or door frame, allowing the door and/or door frame to be easily restored to an original condition following removal of the door-securing latch, and can be intuitively operated by users.

DETAILED DESCRIPTION OF THE INVENTION

Embodiments of the present invention include door-securing latches that allow an occupant of a room or other space accessed through a door to secure the door, from inside the room or other space, in order to prevent entry or access by others. Embodiments of the present invention provide a mechanically strong and secure latch that cannot be easily broken or compromised by application of force to the door or by insertion of a tool or device between the door and an adjacent door frame to disable the latch, but can be disabled by a knowledgeable individual, such as an apartment manger seeking to rescue a disabled apartment occupant in an emergency situation, by straightforward methods that do not result in damage or defacement of the door and/or door frame. Embodiments of the present invention can be installed without defacing the door or door frame, allowing the door and/or door frame to be easily restored to an original condition following removal of the door-securing latch, and can be intuitively operated by users. Certain embodiments of the present invention allow a door, secured by a door-securing latch of the present invention, to be partially opened, to allow the occupant of a room or other space to converse with an individual on the exterior side of the door, to receive an envelope or note, or to otherwise communicate with the exterior space while the door remains securely latched.

Figure 1A:
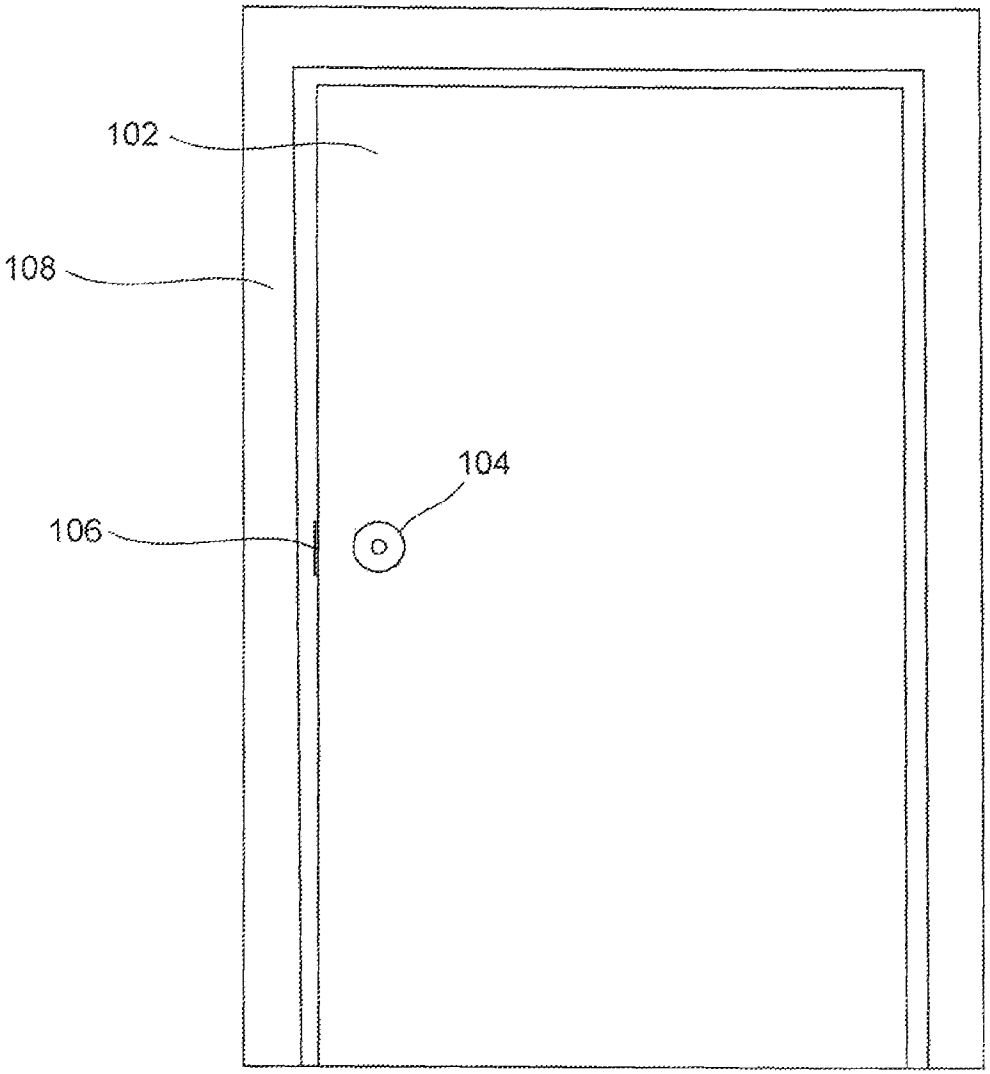
FIGS. 1A-B show a door.
Figure 1B:
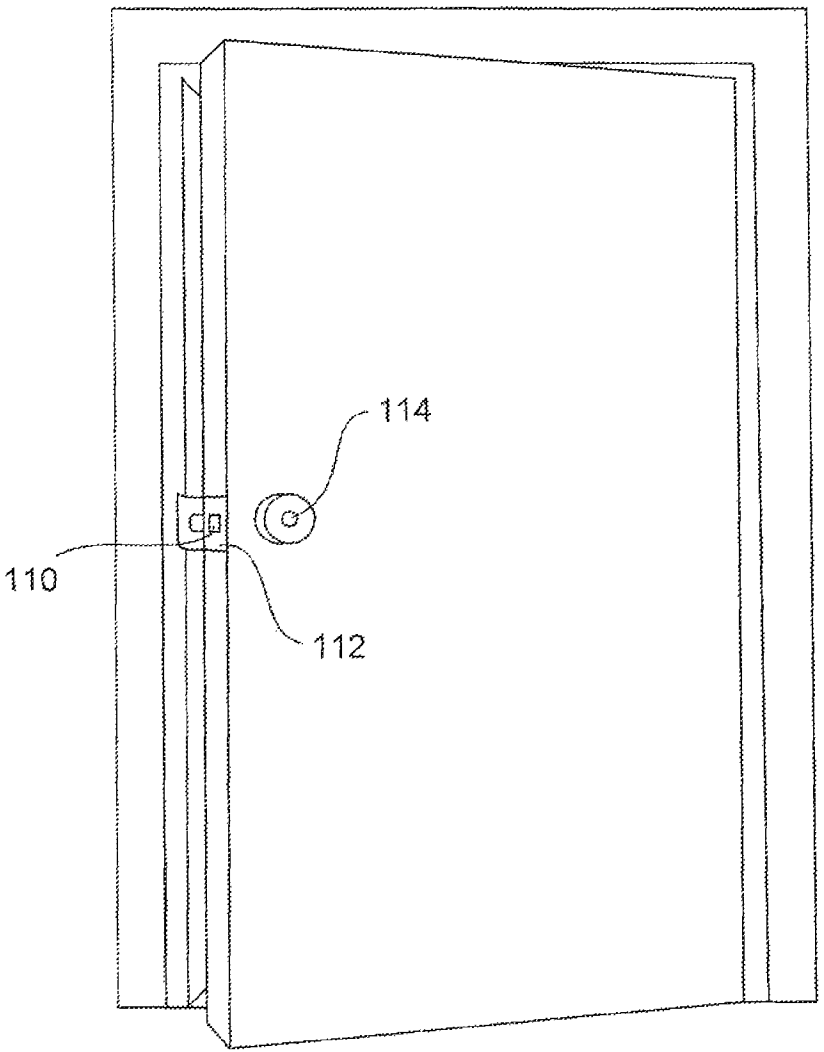

FIGS. 1A-B show a door. The door 102 is mounted within a door frame, and is held in a closed position by a latch, not shown in FIG. 1A, that is retracted by turning a door knob 104 mounted to the door. When the door is closed, the latch extends from an internal cavity in the door through a strike plate 106, mounted to a door frame 108 within which the door is mounted, and into a cavity within the door frame. When the latch (110 in FIG. 1B) is retracted into the door through a door-mounted complementary strike plate 112, by turning the door knob, the door can be opened, as shown in FIG. 1B.

The door knob may include a pushbutton lock 114 and a corresponding key slot on the external side of the door, not visible in FIGS. 1A-B, so that the door can be locked from the inside, by depressing the pushbutton, or from the outside, by inserting and turning a key. Although a door-knob locking system provides a degree of security, door-knob locking systems are often not trusted by occupants of apartments, hotel rooms, and other rooms and spaces to which access is gained through a door. Keys may be stolen or forged, and criminals can often easily pick even expensive locks using commonly-available lock-picking tools and lock-picking instructions widely disseminated on the Internet. Furthermore, should an occupant slightly open the door, as shown in FIG. 1B, to receive a note or converse with a visitor, the door cannot be again secured should the visitor attempt to force entry through the partially opened door.

Figure 2A:
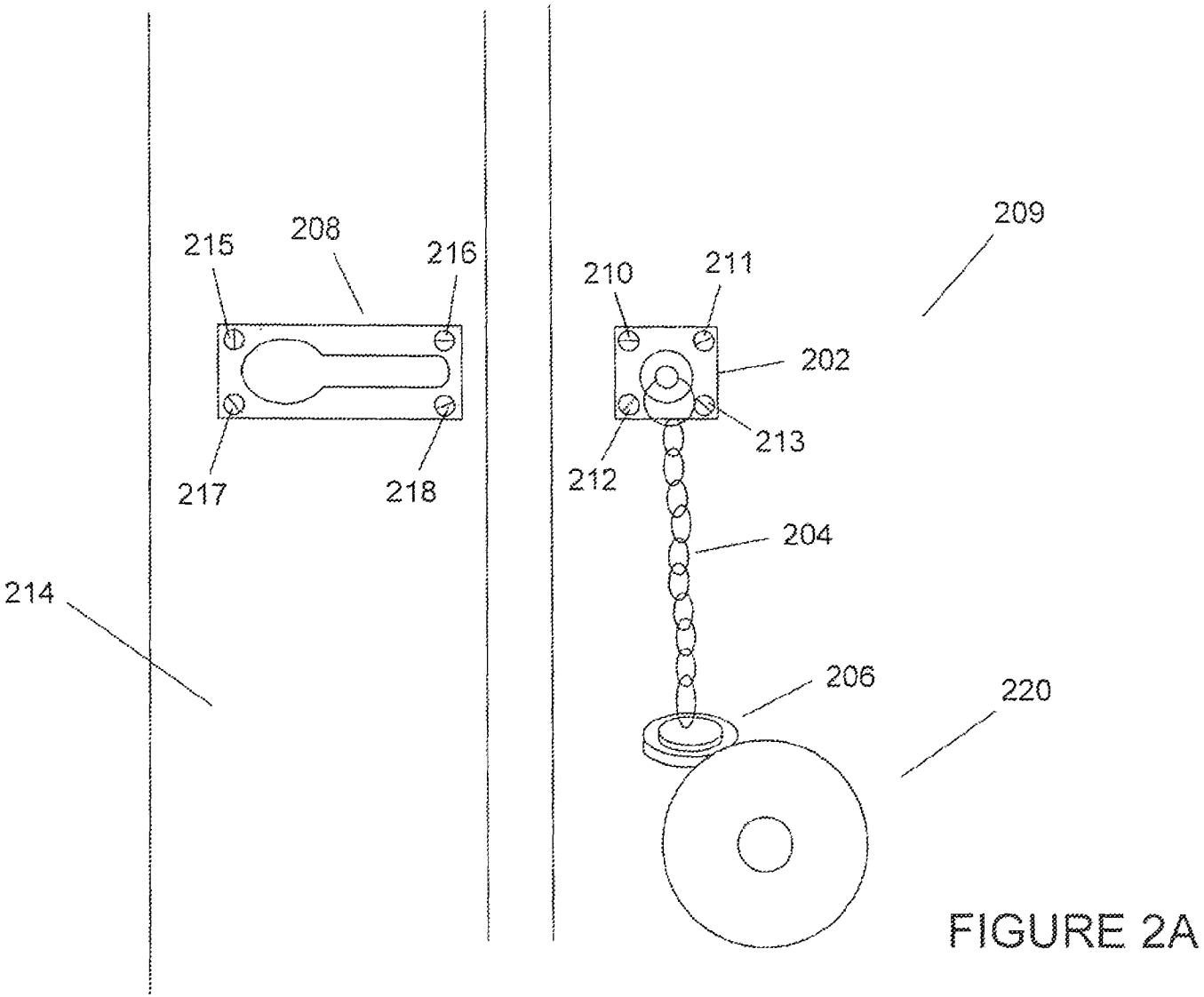
FIGS. 2A-C illustrate a common door security device.
Figure 2B:
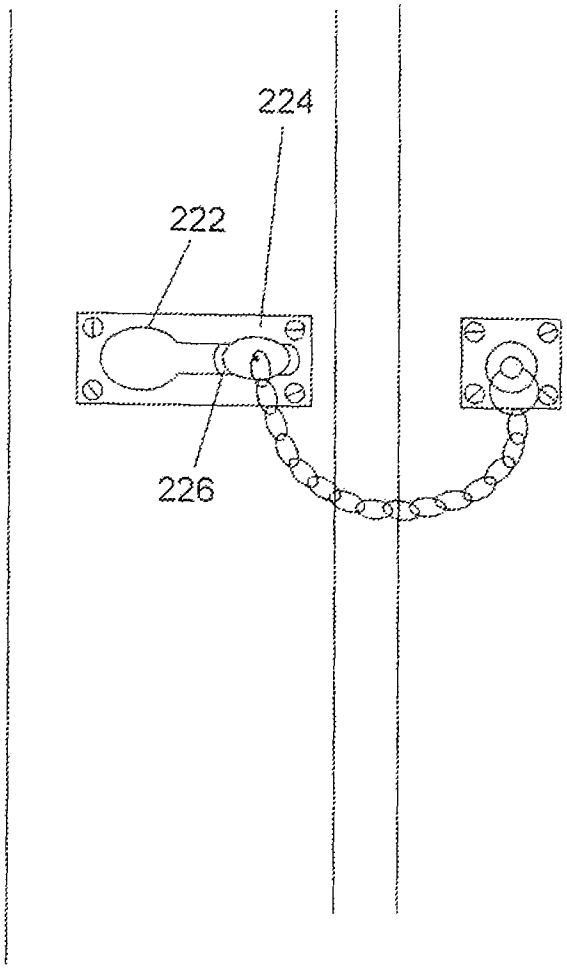
Figure 2C:
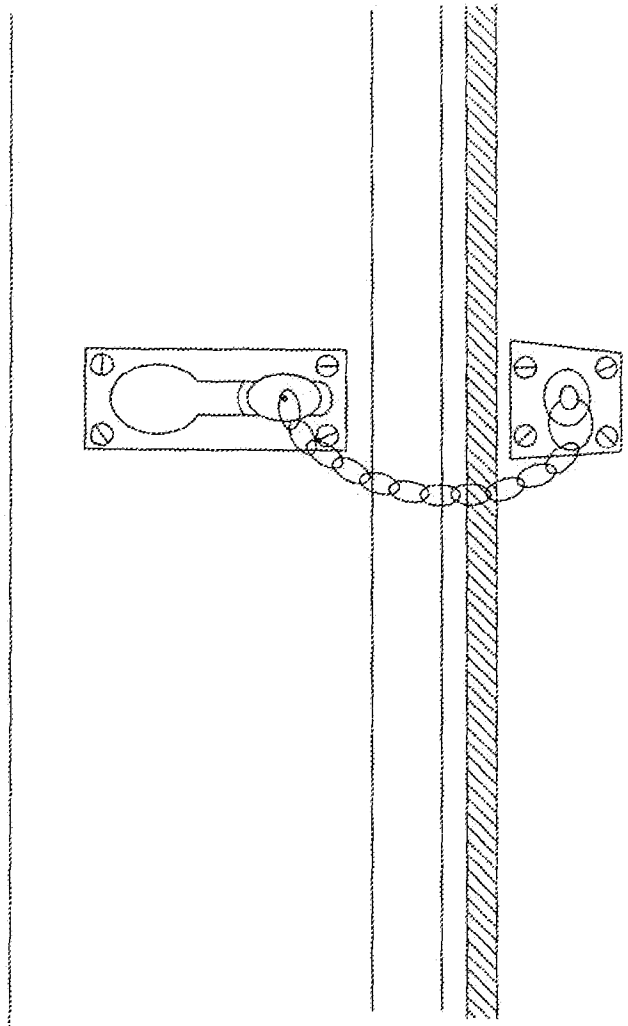

FIGS. 2A-C illustrate a common door security device. The device illustrated in FIGS. 2A-C, referred to as a "door latch chain," is but one example of many different types of security latches that are commercially available and commonly used. The door latch chain is frequently encountered, and provides an example of various disadvantages of the majority of these security latches. The door latch chain comprises a mounting fixture 202, a chain 204, a slider 206, and a slider track mount 208. The chain 204 is permanently mounted to the mounting fixture 202 and is permanently affixed to the slider 206. The mounting fixture 202 is fastened to the door 209 by four screws 210-213 and the slider track mount 208 is fastened to the door frame 214 by four screws 215-218. In FIG. 2A, the door latch chain is not deployed, and the door can be opened and closed by using the door knob 220. The latch is deployed, as shown in FIG. 2B, by placing the slider into a wide portion of the slider track 222 and sliding the slider toward the door. In the narrow portion of the track 224, a base portion 226 of the slider is held securely within the track. As shown in FIG. 2C, the door can be partially opened, but remain latched by the door latch chain.

The door latch chain has many disadvantages. First, the chain is often relatively small, with thin links, and can be broken by application of sufficient force to the door. Second, the screws are mounted so that a force applied to the door is applied in a direction parallel to the screw shafts, which can be easily ripped from the wood door frame and door when sufficient force is applied to the door. Third, were the door latch chain mounted more securely, and a very heavy gauge chain used, it might be difficult for the door latch chain to be disabled should an apartment or hotel manager need to gain entry to an occupied apartment or hotel room in an emergency situation, when the occupant cannot disable the door latch chain. Fourth, installation of the door latch chain requires 8 screw holes to be drilled into the inner faces of the door frame and door, and often requires molding on the door frame and/or door to be milled or routed, to provide secure mounting of the slider track mount 208 and/or mounting fixture 202, when the molding is curved, scalloped, or otherwise non-planar. The 8 screw holes and additional milling may result in a significant defacement of the inner faces of the door and door frame, and may not be acceptable to an apartment manager or landlord.

Many of the different types of security latches currently used suffer some or all of the disadvantages of the door latch chain, and may suffer additional disadvantages. For example, rigid latches with a track and ball mechanism are frequently encountered in hotels. These rigid devices can be non-intuitive and difficult to unlatch in darkness or by panicked room occupants during an emergency. Like the above-described door latch chain, mounting of these devices may result in significant defacement of the door and door frame.

Figure 3B:
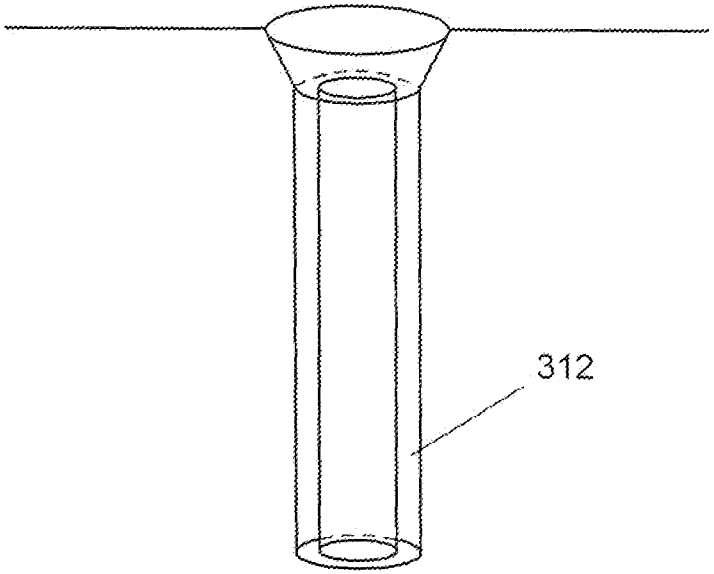
FIGS. 3A-B illustrate strength of a screw in a direction parallel to the screw shaft.
Figure 3A:
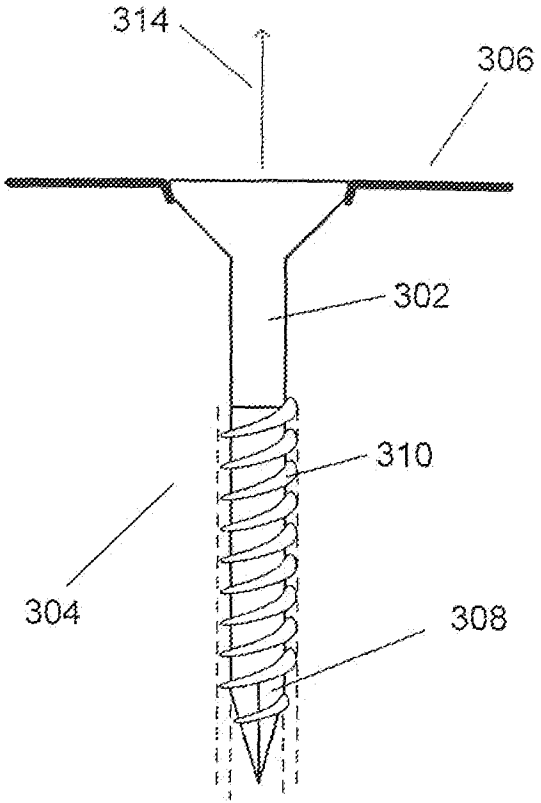

FIGS. 3A-B illustrate strength of a screw in a direction parallel to the screw shaft. In FIG. 3A, a wood screw 302 is shown mounted into a wood door or door frame 304 in order to fasten a latch mechanism 306 to the door or door frame. The screw shaft 308 occupies a cylindrical hole drilled into the wood, and the screw threads 310 cut into the surrounding wood to secure the screw to the wood. As shown in FIG. 3B, only a thin, hollow cylindrical tube 312 of wood, with walls of a thickness equal to the distance that the screw threads protrude from the screw shaft, holds the screw within the wood. A force applied to the screw, via the latch mechanism, in a direction parallel to the screw shaft 314 may easily shear the thin, hollow cylindrical tube 312 of wood from the bulk of the wood, particularly since the walls of the thin, hollow cylindrical tube of wood are helically cut through by the screw threads during mounting of the screw. In essence, the screw is held in place by shear resistance of an area of wood equal to the surface area of the thin, hollow cylindrical tube of wood.

Figure 4B:
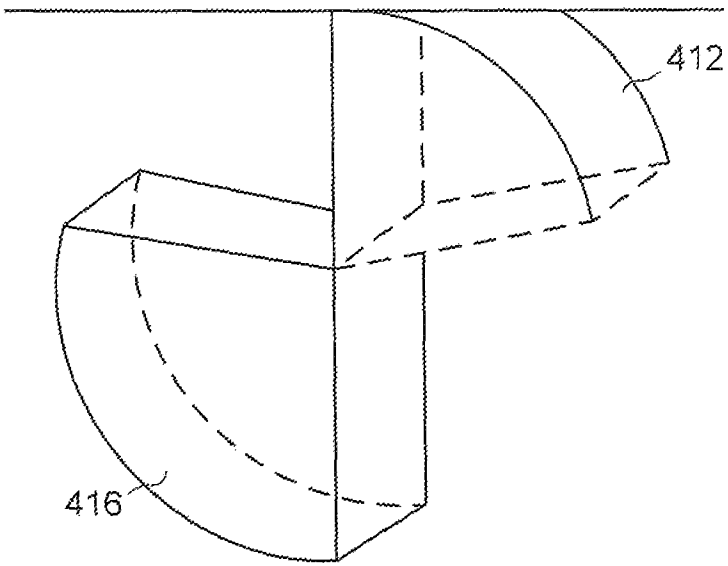
FIGS. 4A-B illustrate strength of a screw in a direction orthogonal to the screw shaft.
Figure 4A:
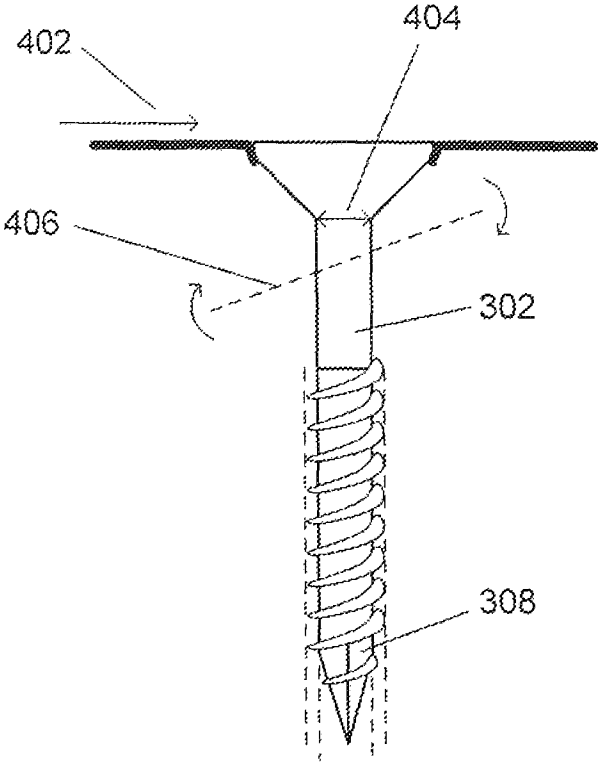

FIGS. 4A-B illustrate strength of a screw in a direction orthogonal to the screw shaft. As shown in FIGS. 4A-B, when a lateral force is applied to the screw, via the latch mechanism, in a direction parallel to the surface of the door or door frame 402 and orthogonal to the screw shaft, there are two plausible modes of failure. Either the screw shaft may be sheared, in a direction orthogonal to the screw shaft 404, or the screw may be rotated about an axis 406 orthogonal to the screw shaft, tearing out two portions 410 and 412 of a disc-shaped volume of wood shown in FIG. 4B. Clearly, a much larger lateral force needs to be applied to the screw in order to cause the screw to fail, in either of these two failure modes. The shear resistance of a wood screw is generally far greater than the shear resistance of a relatively small surface of wood. Tearing a comparatively large volume of wood out from within a volume of wood also generally requires a far greater applied force than that needs to shear a relatively small surface of wood. Thus, were a latching mechanism mounted so that a force applied to a door resulted in application of a lateral force to mounting screws of the latch, as shown in FIGS. 4A-B, rather than a force parallel to the screw shafts, as shown in FIGS. 3A-B, the latch mechanism would be far more resistant to being compromised or broken by application of force to a door on which the latch mechanism is mounted.

FIGS. 5A-E illustrate several embodiments of a security latch that represent a first set of embodiments of the present invention. The first set of security-latch embodiments of the present invention, shown in FIGS. 5A-E, comprises a latch that includes a door-frame mount 502, and articulated latch arm 504, and a latch-pin track 506. The latch-pin track is shown, in FIGS. 5B-D, at different angles: (1) viewed straight on in FIG. 5B, from an angle to the outer surface of the latch-pin track in FIG. 5C, and edge-on in FIG. 5D.

The door-frame mount 502 comprises a generally flat sheet, with four apertures 510-513 through which screws 516-519 mount the door-frame mount 502 to the door frame. The apertures are slightly dimpled, extending into the door frame in the embodiment of the present invention shown in FIG. 5A. Two apertures 510 and 511 are elliptical or slot-like, with rounded ends. The screws 518 and 519 mounted trough these apertures are generally one-way screws, discussed below, which can be installed, but cannot be removed, using a screw driver. The two screws 516 and 517 mounted through the circular apertures 512 and 513 are generally regular screws that can be installed and removed using a screw driver. A flange 522 helps to secure the door-frame mount to the door frame, preventing the door-frame mount from being pushed outward by resting on the edge 524 of the door frame, as well as positioning the door-frame mount so that the latch is flush with the latch-pin track mounted to the door (as shown clearly in FIG. 6A). A shim or spacer may be interposed between the flange and the edge of the door frame to adjust the position of the latch with respect to the plane of the door in a direction normal to the plane of the door. The articulated latch arm 504 includes a first pivot pin 526 which rotatably mounts a first articulated-latch-arm segment 528 to the door-frame mount 502, the first pivot pin passing through an upper mortise arm 530 and lower mortise arm 532 at a first end of the first articulated-latch-arm segment and a tenon arm 534 extending from the door-frame mount 502. The first articulated-latch-arm segment 528 is rotatably mounted by a second pivot pin 536 to a link 538, the second pivot pin passing through an upper mortise arm 540 and lower mortise arm 542 at a second end of the first articulated-latch-arm segment. A second articulated-latch-arm segment 544 is rotatably mounted by a third pivot pin 546 to the link 538, the third pivot pin passing through an upper mortise arm 548 and lower mortise arm 550 at a first end of the second articulated-latch-arm segment. A latch-pin 552 is mounted to the second end of the second articulated-latch-arm segment 544.

The latch-pin track 507 is mounted to the door by two screws 554 and 556 with heads flush with the surface of a rectangular groove that extends across the latch-pin track. The groove includes one or more baffles 560 (more clearly shown in FIG. 6B) that prevent unencumbered back-tracking of the latch pin along the groove. When the latch is deployed, the latch pin 552 fits through a latch-pin aperture 562 for slideable mounting within the groove. The groove has an internal, vertical dimension greater than the groove opening at the surface of the latch-pin track. Once the latch pin is slid along the groove away from the latch-pin aperture 562, the upper 566 and lower 568 portions of the latch pin extending vertically above and below a latch-pin stem 570 that mounts the latch pin to the latch are secured within the groove, and cannot be pulled out of the groove. In other words, the latch pin can be inserted into the groove and removed from the groove only when aligned with the latch-pin aperture 562.

Figure 5B:
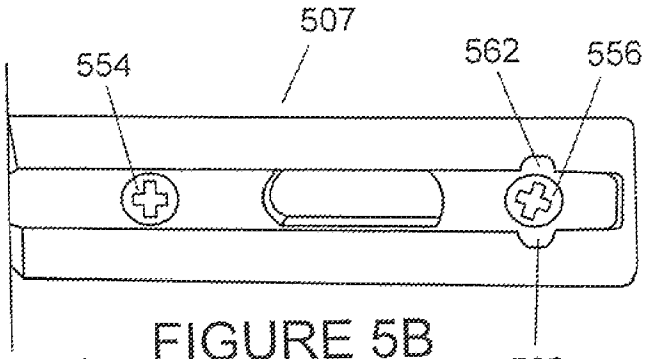
FIGS. 5A-E illustrate several embodiments of a security latch that represent a first set of embodiments of the present invention.
Figure 5C:
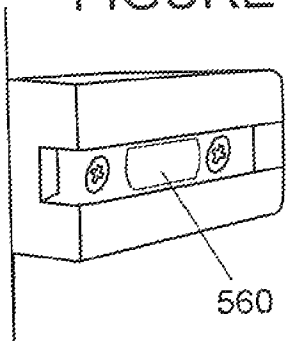
Figure 5D:
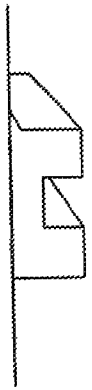
Figure 5A:
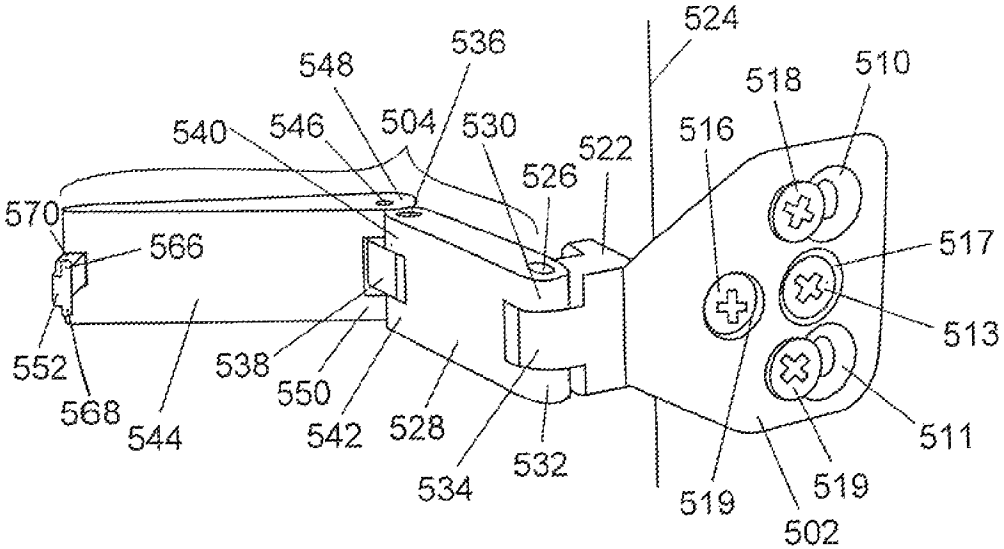
Figure 5E:
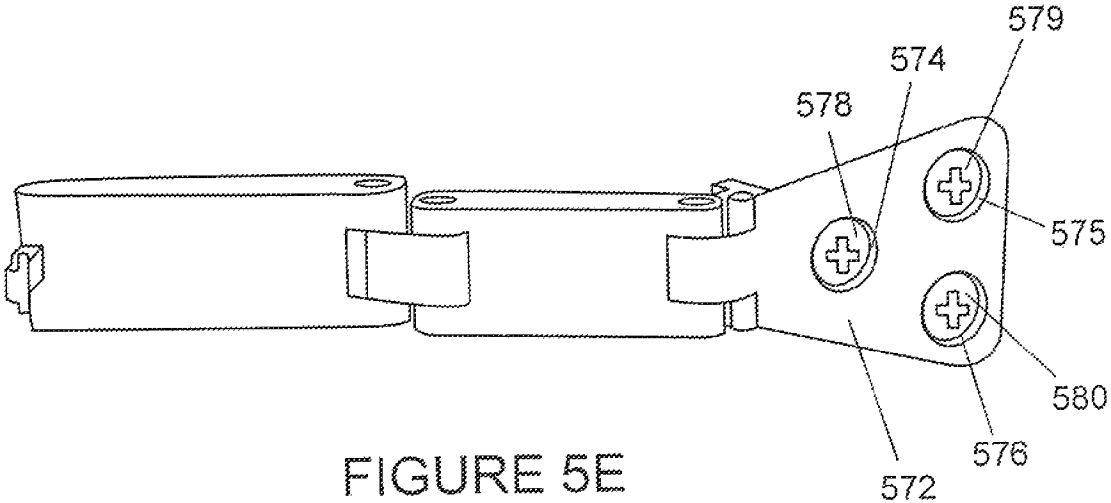

FIG. 5E shows an alternative embodiment of the security latch. In this alternative embodiment, the door-frame mount 572 includes 3 circular, dimpled apertures 574-576 through which three screws 578-580 mount the door-frame mount 572 to the door frame.

Figure 6A:
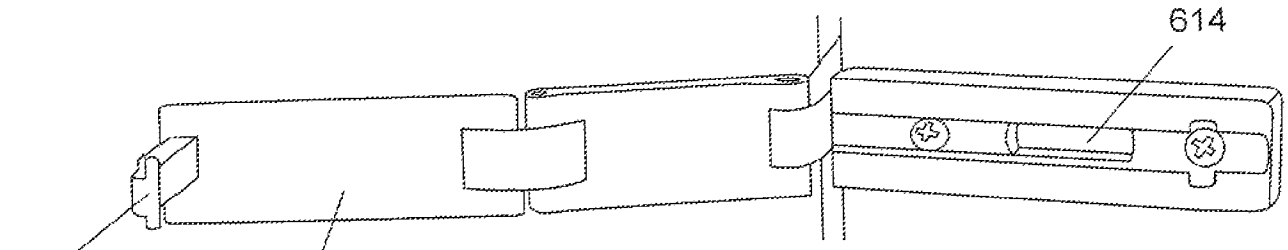
FIGS. 6A-E illustrate deployment of the security-latch embodiments of the present invention shown in FIGS. 5A-E.
Figure 6B:
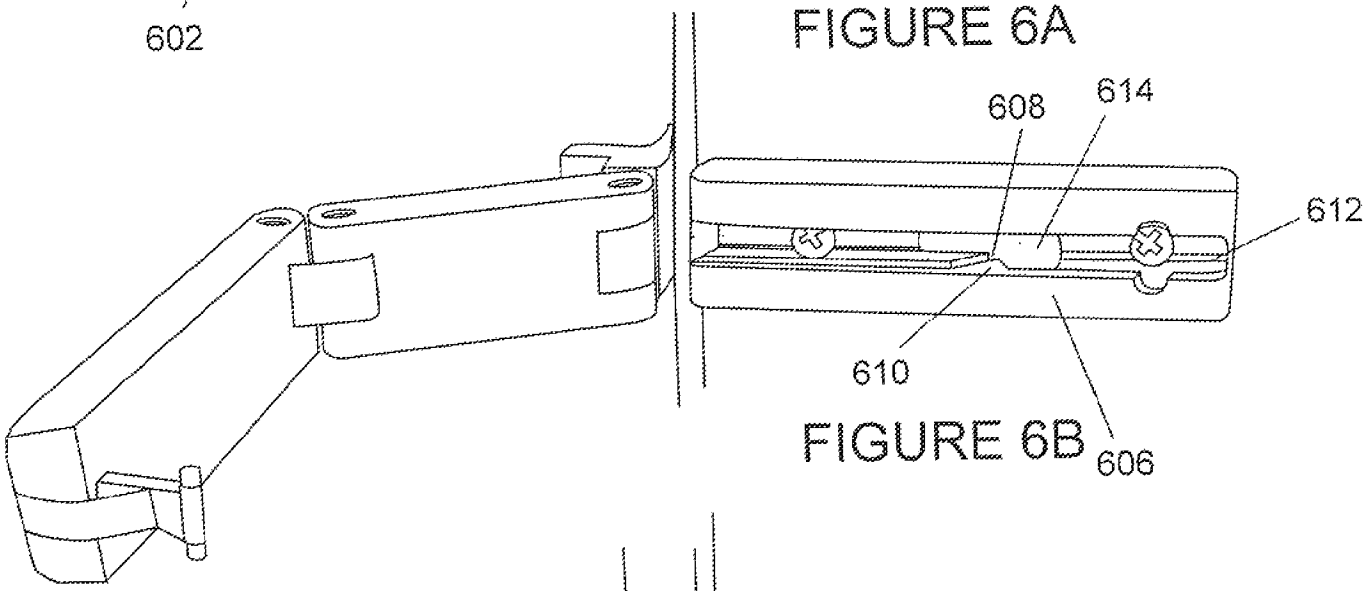

FIGS. 6A-E illustrate deployment of the security-latch embodiments of the present invention shown in FIGS. 5A-E. In an open position, shown in FIG. 6A, the latch 602 is extended across the door frame. The latch pin 604 can be moved in a horizontal plane by manipulating the latch pin so that the articulated-latch-arm segments pivot about the pivot pins and change their orientations with respect to one another, the link, and the door-frame mount. In FIG. 6B, the latch is moved towards the latch-pin track 606, and in FIG. 6C, the latch pin is moved even further towards the latch-pin track.

Figure 6C:
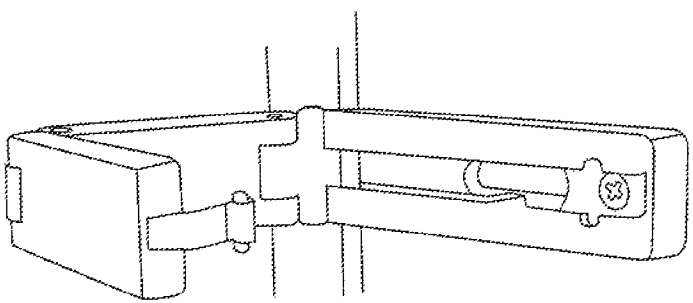

The baffle 608 is more clearly visible in FIGS. 6A-C. The baffle includes a deflector 610 in the lower portion of the groove 612 that causes the latch pin to move inward, into a depression 614 in the surface of the groove when the latch pin is slid along the groove from a position closer to the edge of the door than the baffle past the deflector towards the end of the latch-pin track opposite from the door edge. A complementary deflector may also be fashioned in the upper portion of the groove. The baffle ensures that the latch-pin cannot be slid from a closed position back to the latch-pin aperture by shaking or jarring the door. Instead, the latch-pin is deflected into the depression 614, which has a straight, back edge against which the latch-pin comes to rest. The latch-pin is easily manually returned to the tracks for sliding back to the latch-pin aperture for removal. The lower and upper portions of the groove form tracks in which the ends of the latch-pin are slideably secured. The tracks are linear, except where the deflectors angle the tracks inward, into the depression 614. Additional baffles may be included in alternative embodiments of the present invention.

Figure 6D:
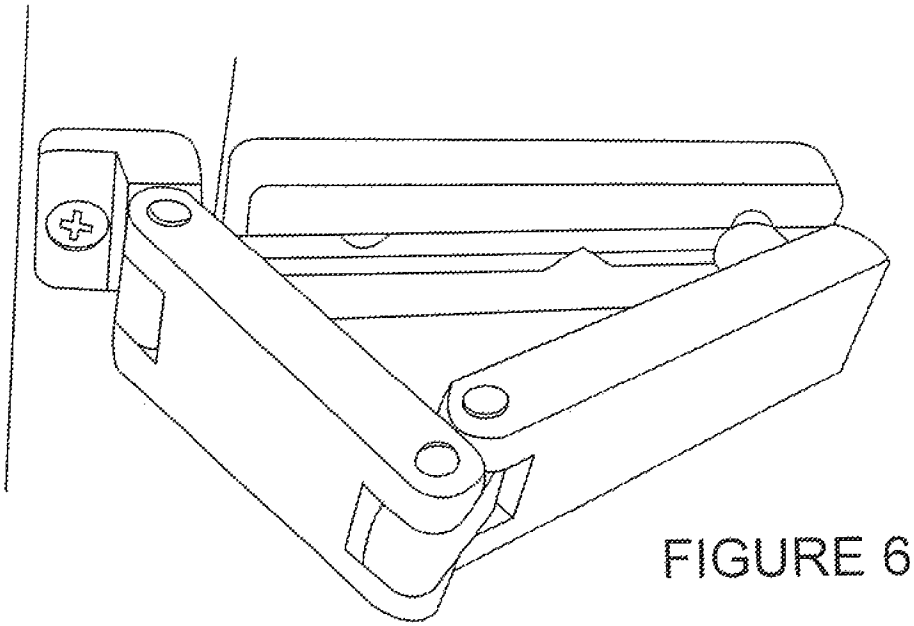

In FIG. 6D, the latch has been curled all the way over to allow the latch pin to be inserted into the latch-pin aperture. Finally, in FIG. 6E, the latch pin has been slid along the groove and tracks to a closed position, with the latch pin resting against the end of the groove near the end of the latch-pin track flush with the edge of the door. Note that the upper and lower tracks, in which the ends of the latch pin slide, terminate before reaching the end of the latch-pin track, so that the latch pin cannot be slid out of the latch-pin track, at either end of the latch-pin track.

Figure 7A:
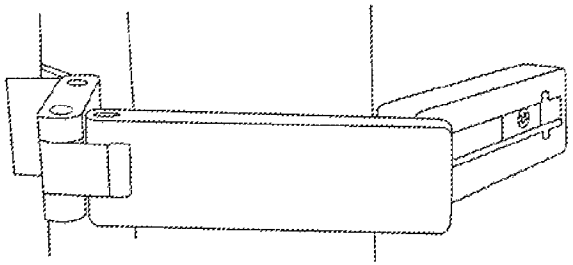
FIGS. 7A-C illustrate partial opening of a door secured by a security latch that represents a first embodiment of the present invention.
Figure 7B:
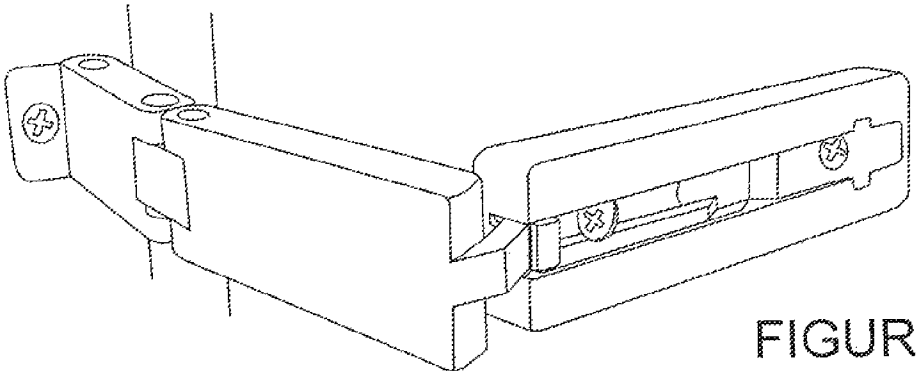
Figure 7C:
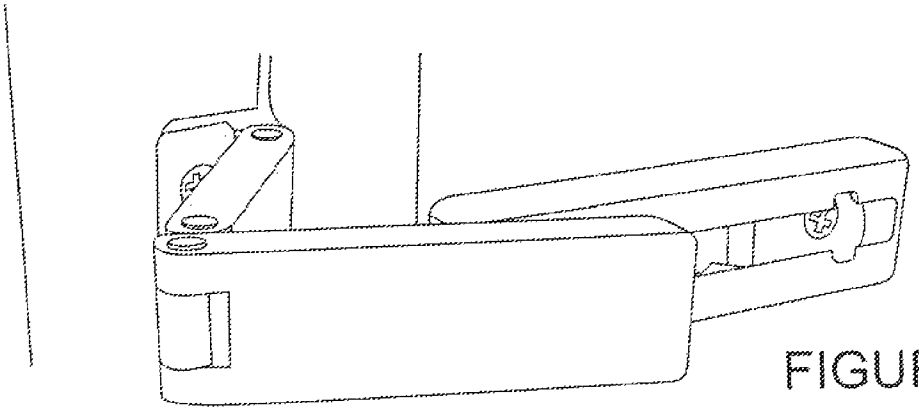

FIGS. 7A-C illustrate partial opening of a door secured by a security latch that represents a first embodiment of the present invention. In FIG. 7A, the door has been cracked, with pivoting of the articulated-latch-arm segments about the pivot pins allowing the latch to extend in an inward direction, to allow the door to open slightly while the latch pin remains secured within the latch-pin track. In certain embodiments of the present invention, as shown in FIG. 7C, the geometry of the latch, latch pin, and latch-pin track prevent the door from being cracked, when the latch pin occupies certain ranges of positions along the groove. It is to address this characteristic of certain embodiments of the present invention that the slot-like apertures (510 and 511 in FIG. 5A) are included, as well as shallow, slot-like cavities are milled out of the wood frame below all four apertures 510-513. When the door cannot be cracked, as shown in FIG. 7C, it is difficult for an apartment manager or hotel manager to disable the security latch in order to rescue a disabled apartment occupant or hotel-room occupant. However, pushing the door forward, to the position sown in FIG. 7C exposes the screw heads within the door-frame mount (502 in FIG. 5A). A rescuer can use a screw driver or screw-bit-equipped power tool to remove the two regular-head screws 516-517. The rescuer can then apply a shoulder to the door, or otherwise apply a force to the door, in order to shove the door-frame mount inward, with the dimples of the apertures moving freely within milled, slot-like cavities in the door frame, and the door-frame mount sliding underneath the two one-way screws 518-519. In other words, the door-frame mount can slide inward by a distance equal to the lengths of the slot-like apertures 510 and 511 when the door-frame mount is correctly installed, with the one-way screws initially installed at the inward ends of the slot-like apertures. Once the door-frame mount has been slid forward, the door is opened far enough to allow a rescuer to insert a reciprocating saw blade through the opening to saw off the latch, to allow entry to the room. Note that the security latch can be mounted to either side of the door or, in other words, is reversible. Also note that all milling and drilling occurs in the edge of door frame, rather than on the inner face, so that the inner face of the door frame is not defaced. The screw holes can be easily filled with plastic wood or another filler. Although two screw holes are drilled into the door, they also can be filled, after removal of the security latch. In general, one or two screw holes are less damaging than the four, closely spaced screw holes of currently-available latches, and generally do not result in significant defacement of the door.

Figure 8:
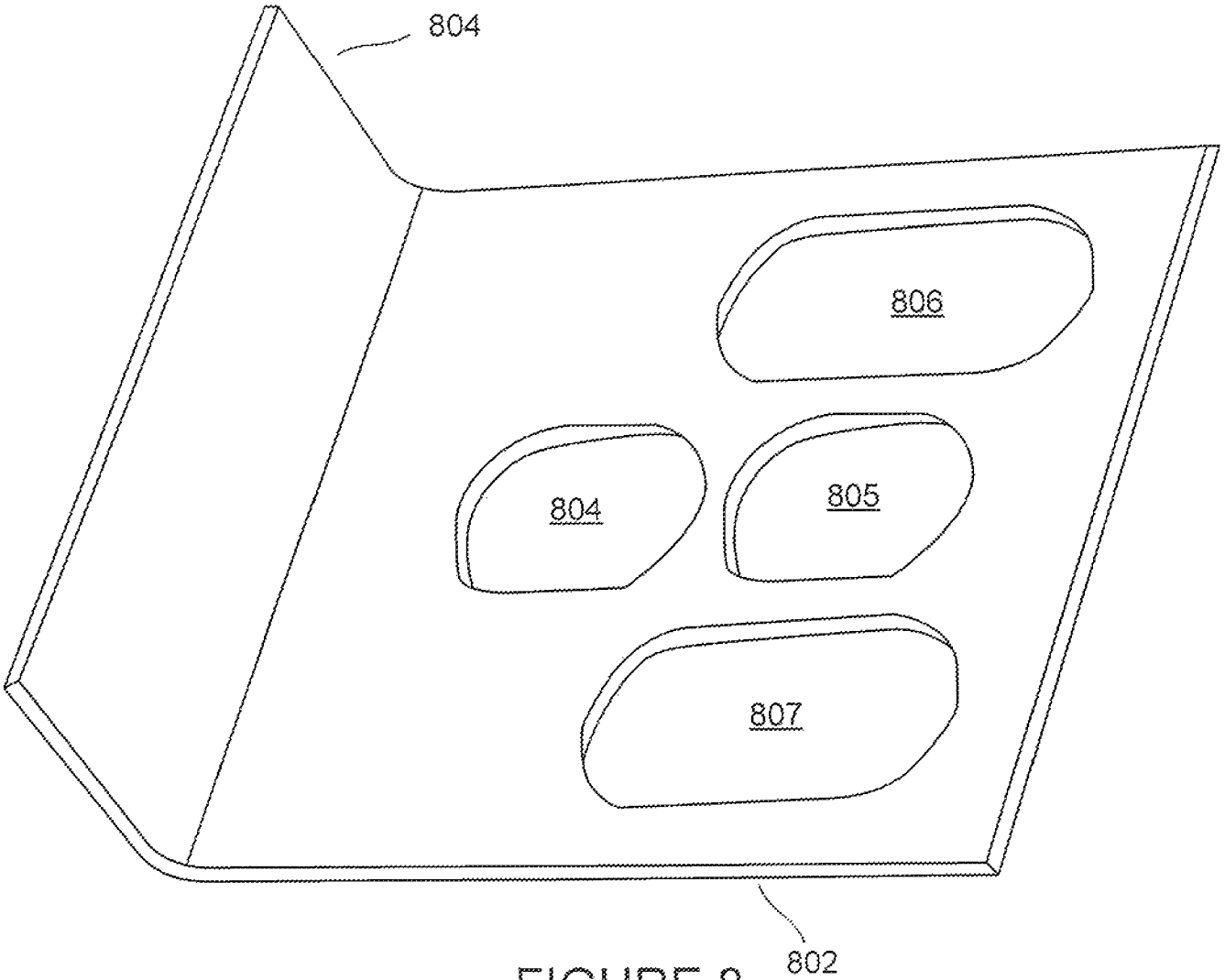
FIG. 8 illustrates a template used to mark a door frame for routing, according to one embodiment of the present invention.

FIG. 8 illustrates a template used to mark a door frame for routing, according to one embodiment of the present invention. The template is placed over the wood frame, with the flange 804 against the edge of the door frame. Then, aperture outlines can be marked onto the wood frame through the template apertures 804-807. The template is then removed, and a router or other tool is used to mill out slot-like cavities, of a depth equal to the height of the dimples, or annular flanges, protruding from the back surface of the door-frame mount. Pilot holes for the screws are drilled either prior to milling or after milling the cavities.

Figure 9:
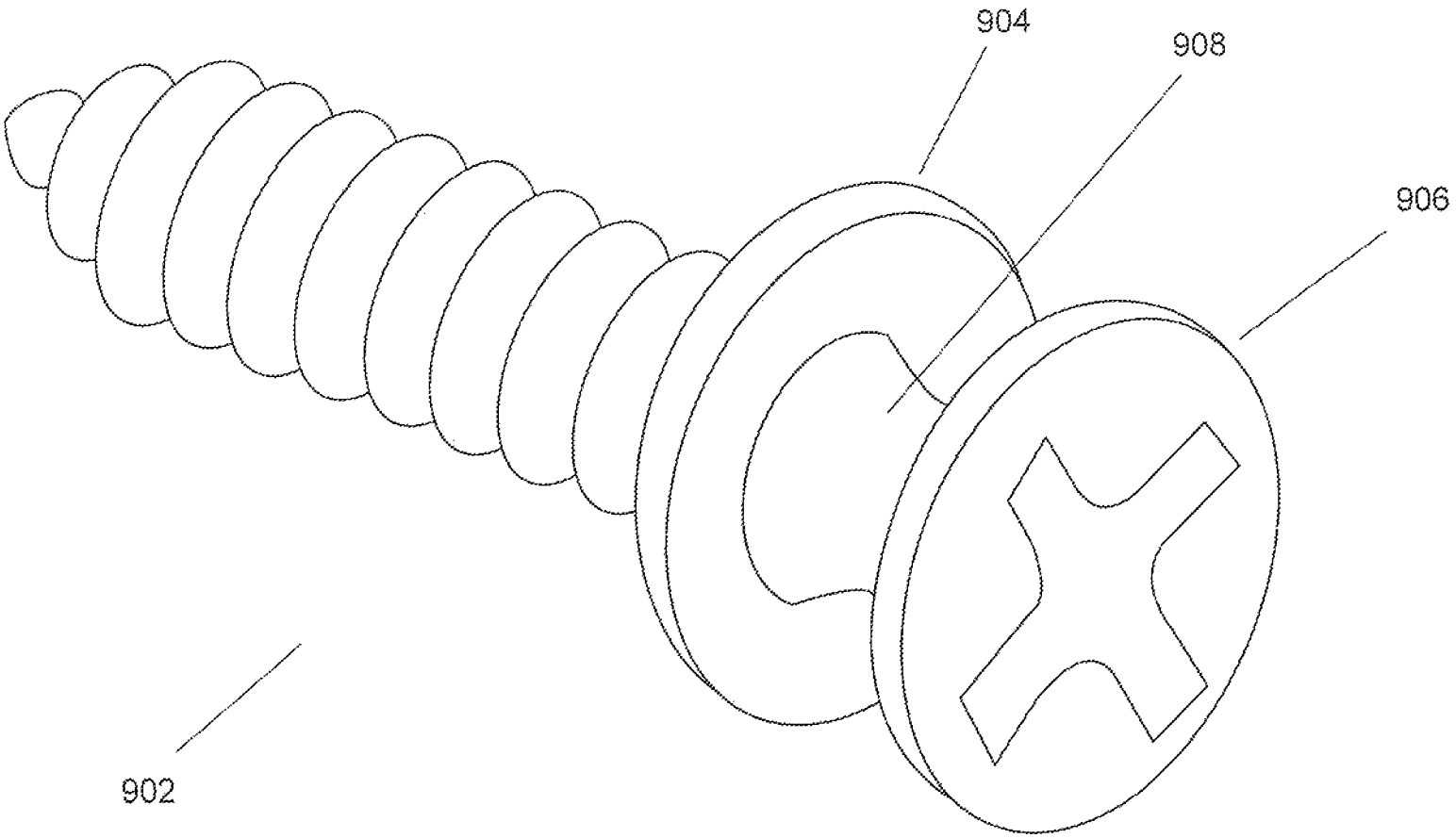
FIG. 9 illustrates a first type of one-way screw that represents one embodiment of the present invention.

FIG. 9 illustrates a first type of one-way screw that represents one embodiment of the present invention. Currently-available one-way screws generally have rounded heads that protrude from the surface of a flat object, like the door-frame mount, that they secure. However, the door-frame mount needs to be thin and flat, to allow the door to close over the door-frame mount. Therefore, currently-available one-way screws are unsuitable for mounting the security latch that represents one embodiment of the present invention. Regular screws could be removed by an individual seeking to break into an apartment or hotel room, once the door is opened even slightly. The double-headed screw 902 can be screwed into the wood frame so that the first screw head 904 is flush with the surface of the door-frame mount. The second head 906 and shaft 908 connecting the second head and the first head can then be cut off, snipped off, or sheared off, to leave an installed, one-way screw flush with the surface of the door-frame mount.

Figure 10B:
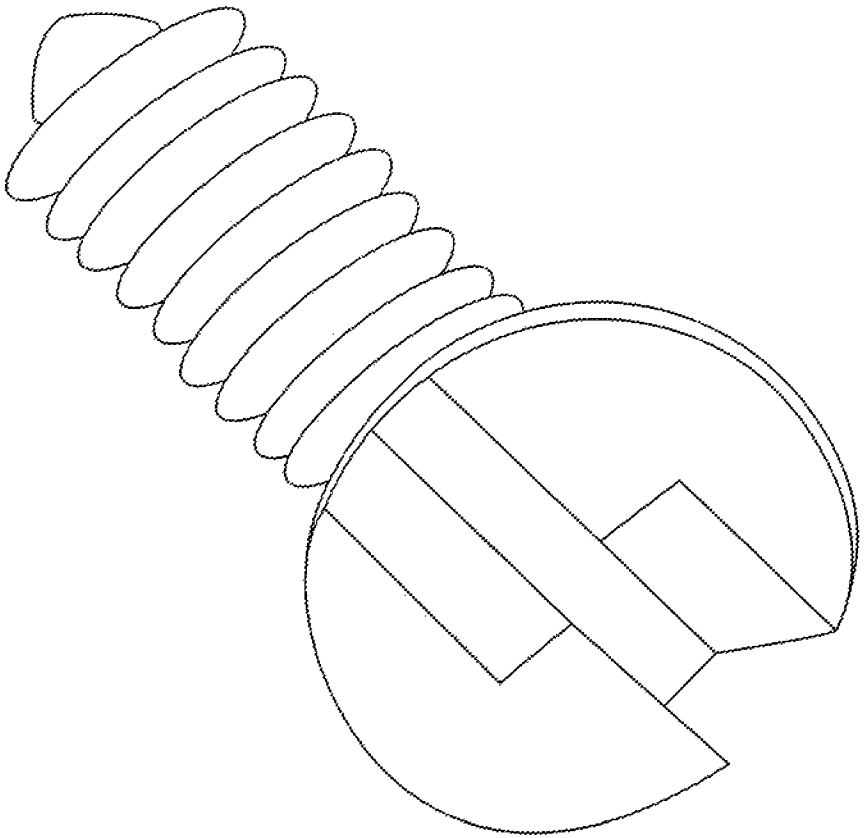
FIGS. 10A-B illustrate a second type of one-way screw that represents one embodiment of the present invention.
Figure 10A:
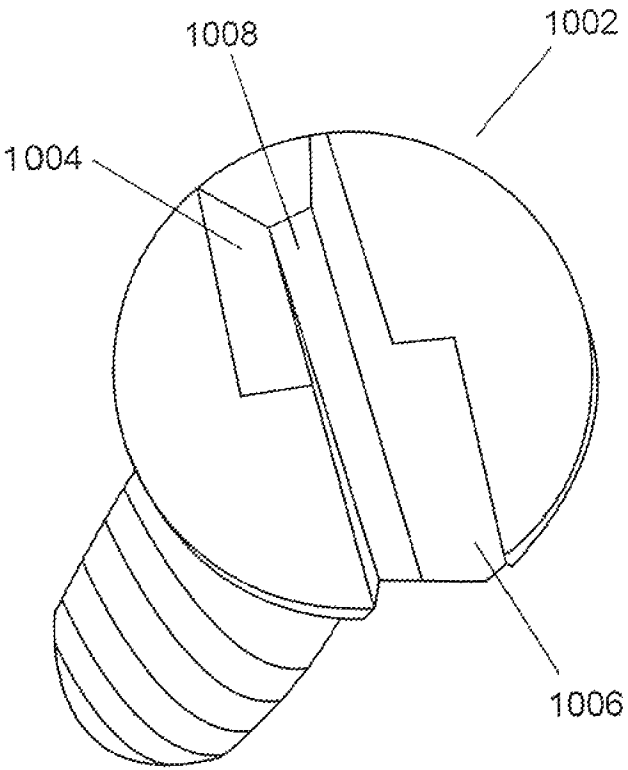

FIGS. 10A-B illustrate a second type of one-way screw that represents one embodiment of the present invention. This second type of flat-head one-way screw 1002 includes bevels 1004 and 1006 on the upper left side of the slot 1008 for a screw driver and on the lower right side of the slot. The unbeveled edges of the slot allow the screw to be rotated by a screw driver in a clockwise direction, for mounting, but the beveled edges cause the screwdriver to slip out from the slot if the screwdriver is rotated in a counter-clockwise direction.

Figure 11:
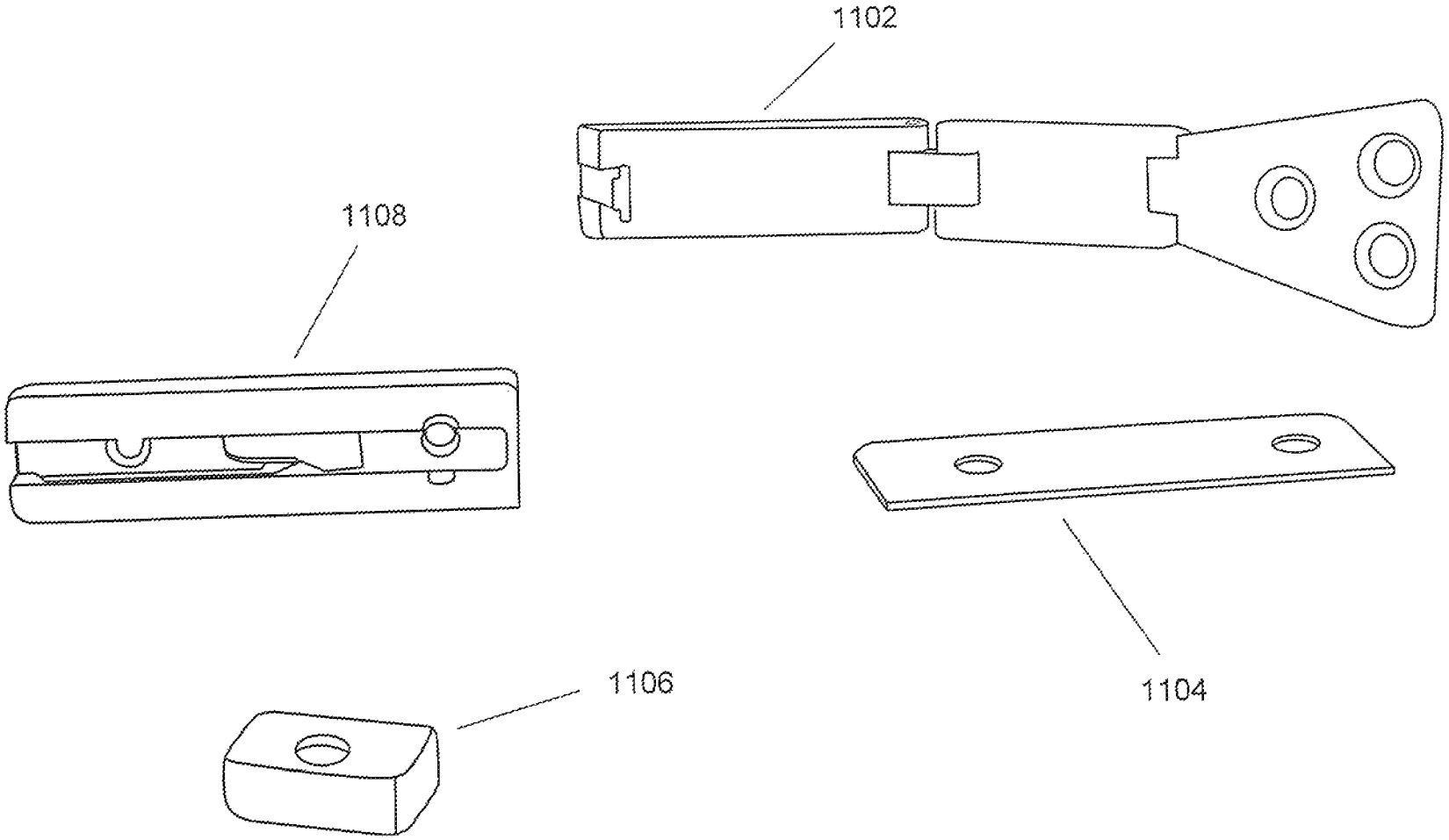
FIG. 11 illustrate an installation kit for a security latch that represents a first embodiment of the present invention.

FIG. 11 illustrate an installation kit for a security latch that represents a first embodiment of the present invention. The installation kit includes the latch 1102, a shim 1104 for mounting beneath the latch-pin track, when needed, a shim 1106 for mounting between the door frame and door-frame-mount flange, as described above with reference to FIG. 5A, and the latch-pin track 1108. The installation kit may also include regular screws and one-way screws, a template, such as the template shown in FIG. 8, appropriate for the door-frame mount configuration, and additional shims of different thicknesses.

Figure 12B:
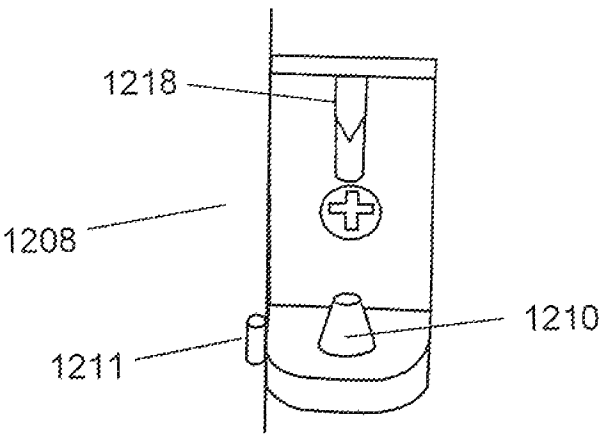
FIGS. 12A-D illustrate several embodiments of a security latch that represent a second set of embodiments of the present invention.
Figure 12C:
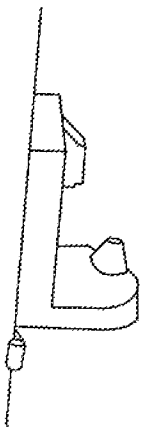
Figure 12D:
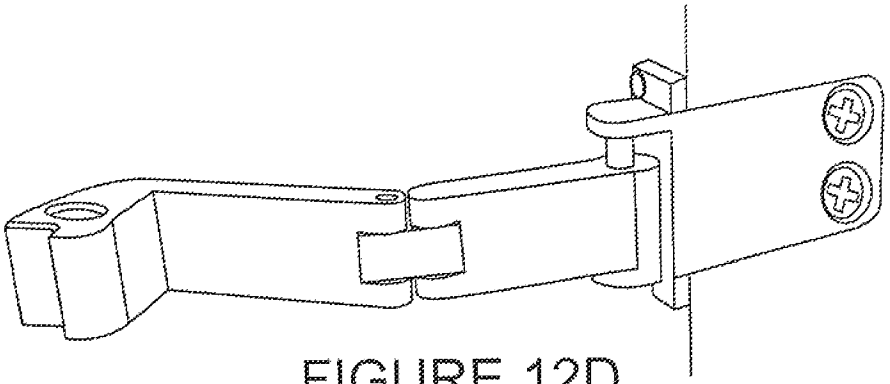
Figure 12A:
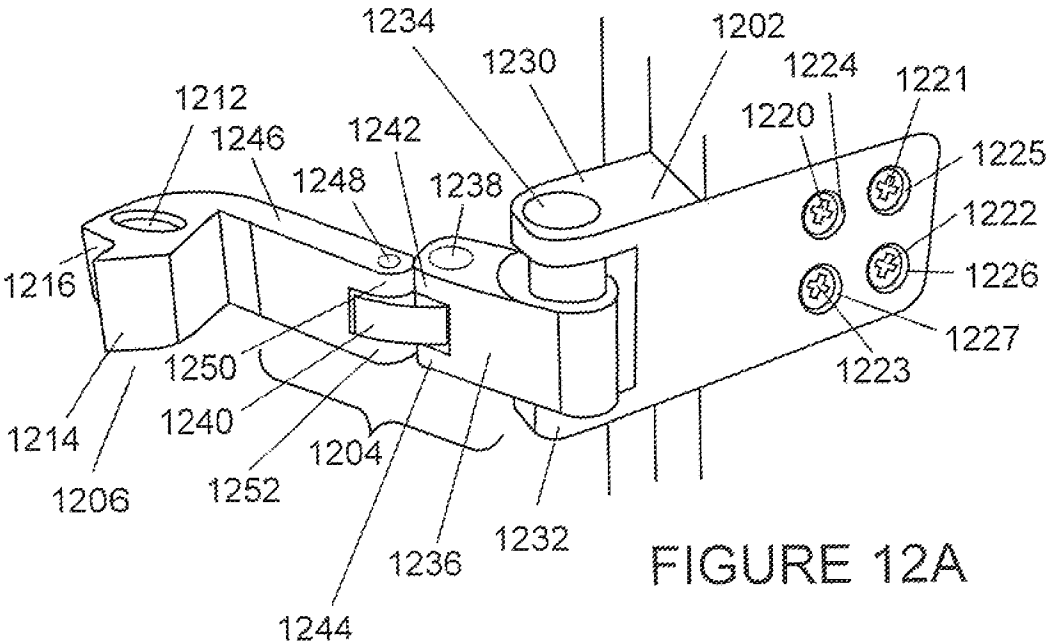

FIGS. 12A-D illustrate several embodiments of a security latch that represent a second set of embodiments of the present invention. As shown in FIG. 12A, the second embodiment of the present invention includes, like the first embodiment of the present invention, a latch that includes a door-frame mount 1202 and an articulated latch arm 1204. The security latch shown in FIG. 12A, unlike the first embodiment of the present invention, includes a latch head 1206 rather than a latch pin. FIGS. 1B-C show a latch pin-and-guide assembly. The latch pin-and-guide assembly 1208 includes a latch pin 1210 onto which the latch head is seated, with the latch pin extending into a lower end of a latch-head hole 1212. The latch head 1206 includes a latch-head guide flange 1214, a planar, inside edge 1216 of which is parallel with the axis of the cylindrical latch-head hole. The planar, inside edge of the latch-head guide flange slides against the left-hand side of a latch-head guide 1218 of the latch pin-and-guide assembly while the latch head is lowered down, onto the latch pin to secure the door. Subsequently, as the door is opened, the latch head rotates about the latch pin so that the latch-head guide flange is secured beneath the latch-head guide, so that the latch cannot be forced upward by an intruder by inserting a hand or tool through a crack in the door. A mounted pin 1211 on the side of the latch pin-and-guide assembly prevents insertion of a knife or tool through a crack in the door to raise the latch arm and disable the security latch prior to sufficient rotation of the latch head about the latch pin to cause the latch head to be secured by the latch-head guide. FIG. 12D shows an alternative embodiment of the security latch shown in FIG. 12A. The security latch in FIG. 12A uses four mounting screws 1220-1223, mounted through four corresponding dimpled apertures 1224-1227 in the door-frame mount 1202. By contrast, the security latch shown in FIG. 12D uses only two screws. As with the first set of embodiments of the present invention, some or all of the mounting screws may be one-way screws, so that an intruder cannot force the door partially open and then unscrew the door-frame mount 1202 from the door frame in order to disable the security latch.

The door-frame mount 1202 comprises a generally flat sheet, with four apertures 1224-1227 through which screws 1220-1223 mount the door-frame mount 502 to the door frame. The apertures are slightly dimpled, extending into the door frame in the embodiment of the present invention shown in FIG. 12A. An upper mortise arm 1230 and lower mortise arm 1232 secure a large pivot pin 1234, on which a first articulated latch-arm segment 1236 is mounted. The back of the mortise arms helps to secure the door-frame mount to the door frame, preventing the door-frame mount from being pushed outward by resting on the edge of the door frame, as well as positioning the door-frame mount so that the latch is flush with the latch pin-and-guide assembly mounted to the door. A shim or spacer may be interposed between the back of the mortise arms and the edge of the door frame to adjust the position of the latch with respect to the plane of the door in a direction normal to the plane of the door. The first articulated-latch-arm segment 1236 is rotatably mounted to the large pivot pin 1234 through a cylindrical aperture in the first articulated-latch-arm segment. The first articulated-latch-arm segment 1236 is rotatably mounted by a second pivot pin 1238 to a link 1240, the second pivot pin passing through an upper mortise arm 1242 and lower mortise arm 1244 at a second end of the first articulated-latch-arm segment. A second articulated-latch-arm segment 1246 is rotatably mounted by a third pivot pin 1248 to the link 1240, the third pivot pin passing through an upper mortise arm 1250 and lower mortise arm 1252 at a first end of the second articulated-latch-arm segment. The second end of the second articulated-latch-arm segment forms the latch head 1206.

Figure 13A:
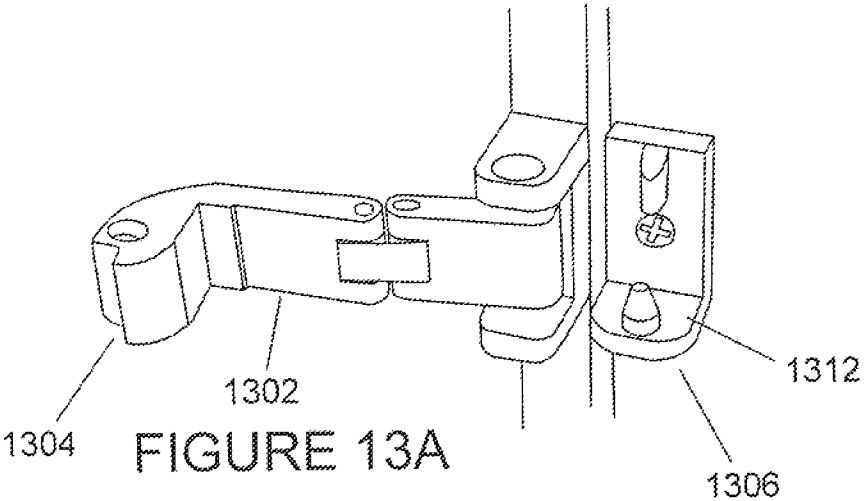
FIGS. 13A-C illustrate deployment of the security-latch embodiments of the present invention shown in FIGS. 12A-D.
Figure 13B:
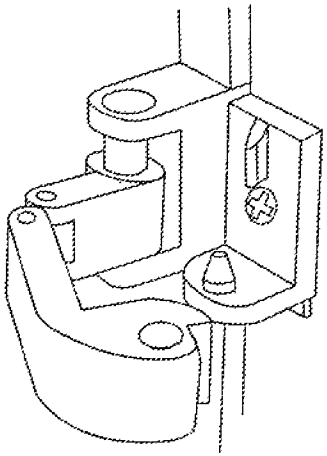
Figure 13C:
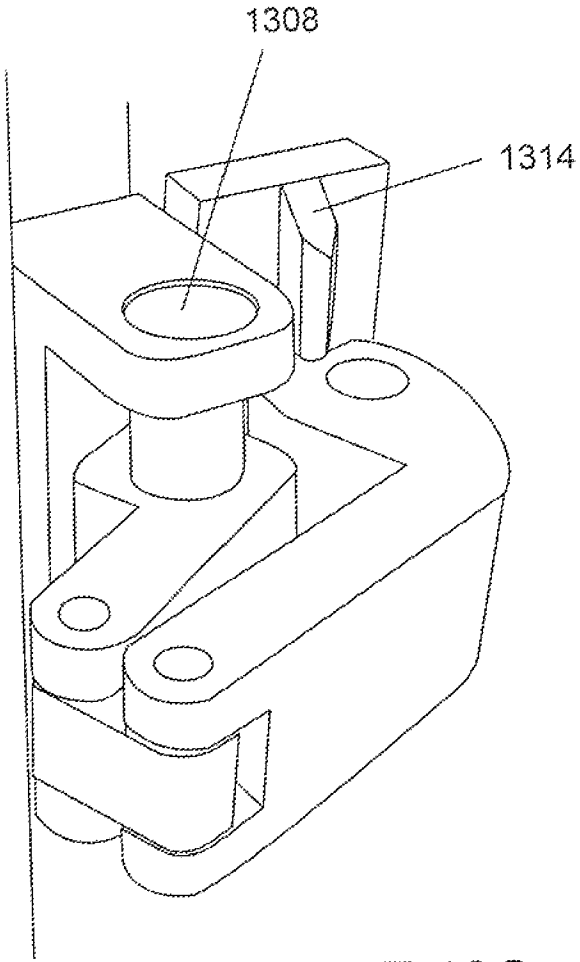

FIGS. 13A-C illustrate deployment of the security-latch embodiments of the present invention shown in FIGS. 12A-D. In an open position, shown in FIG. 13A, the latch 1302 is extended across the door frame. The latch head 1304 can be moved in a horizontal plane by manipulating the latch so that the articulated-latch-arm segments pivot about the pivot pins and change their orientations with respect to one another, the link, and the door-frame mount. In FIG. 13B, the latch is moved towards the latch pin-and-guide assembly 1306, and in FIG. 13C, the latch head has been raised, by raising the entire latch arm by sliding the latch arm upward on the large pivot pin 1308, the bottom of the latch-head hole has been lowered over the latch pin, and the entire latch arm has been lowered so that the latch head rests on a bottom platform 1312 of the latch pin-and-guide assembly. Note that the inner edge of the latch-head flange rests against the left-hand side of the latch-head guide 1314 in FIG. 13C, as discussed above.

Figure 14B:
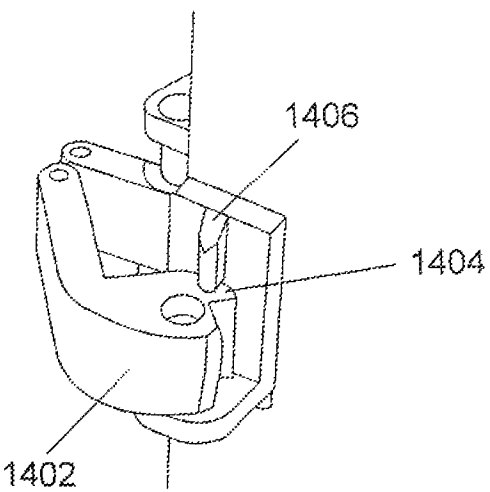
FIGS. 14A-C illustrate deployment of the security-latch embodiments of the present invention shown in FIGS. 12A-D.
Figure 14C:
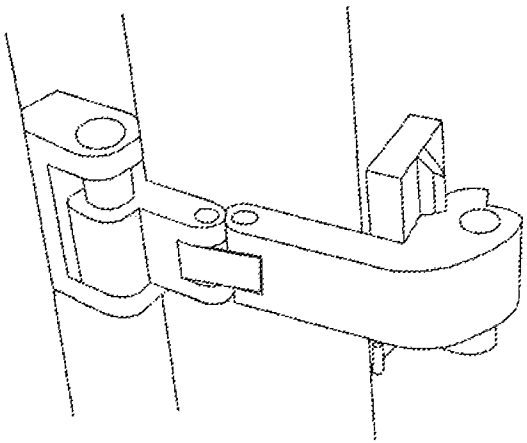
Figure 14A:
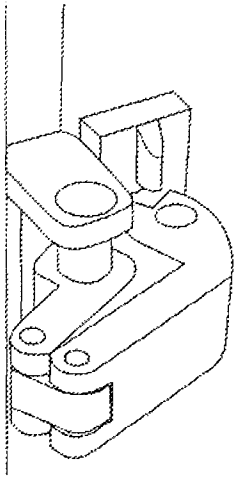

FIGS. 14A-C illustrate deployment of the security-latch embodiments of the present invention shown in FIGS. 12A-D. In FIG. 14A, the door is closed. In FIG. 14B, the door has been cracked, displacing the door inward and causing the latch head 1402 to rotate about the latch pin, so that the latch-head flange 1404 is now below the latch-head guide 1406 on the latch pin-and-guide assembly, secured in position by the latch-head guide. In FIG. 14C, the door is opened still further, fully extending the latch arm. The door cannot be further opened, and the latch can only be disabled by cutting the latch arm using a reciprocal saw inserted through the opening of the door, or by use of some other tool.

Figure 15B:
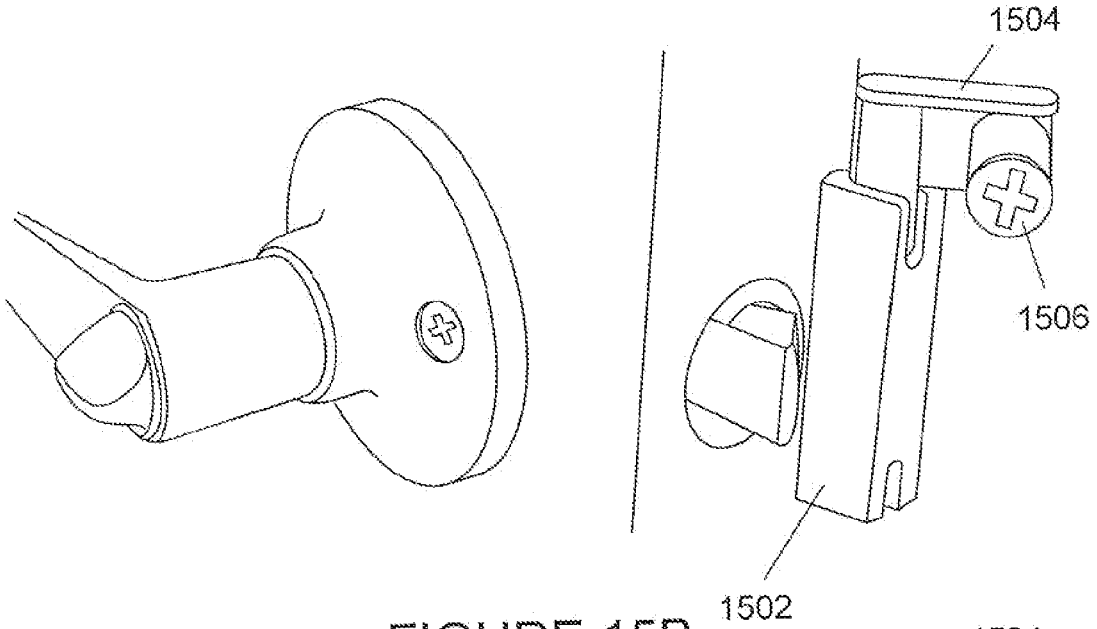
FIGS. 15A-C illustrate a third security-latch embodiment of the present invention.
Figure 15A:
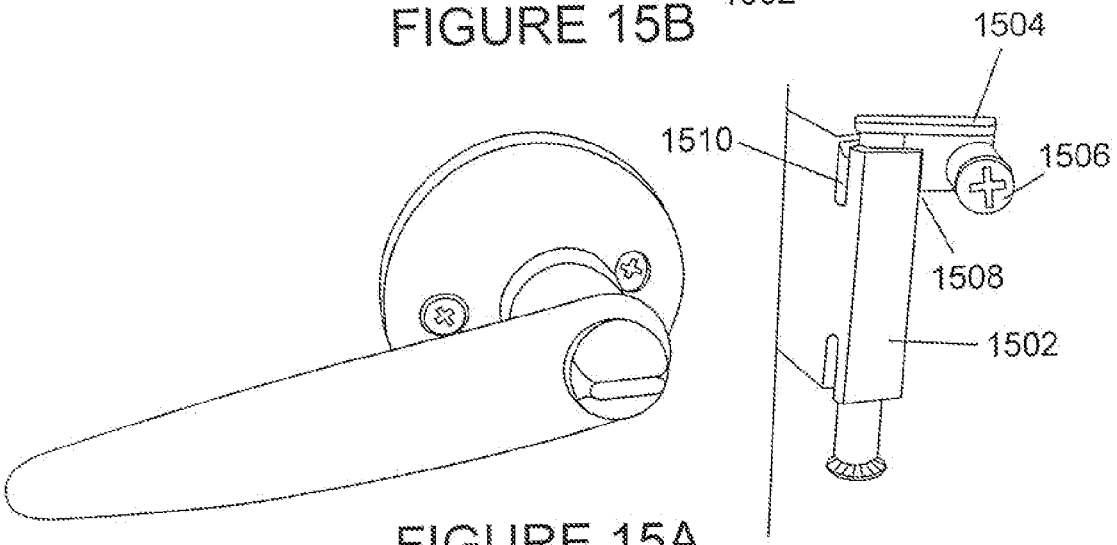
Figure 15C:
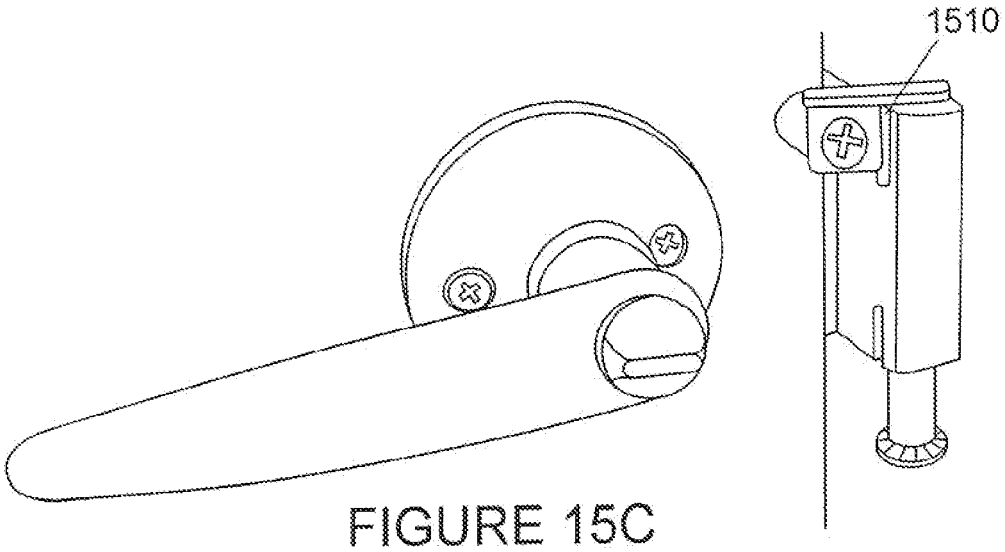

FIGS. 15A-C illustrate a third security-latch embodiment of the present invention. The security latch includes a door-frame mount 1502 that replaces the striker plate for the door lever on the door frame (not shown in FIGS. 15A-C) and that rotatably holds a latch arm 1504 with a door stop 1506. In an open state, shown in FIG. 15A, the latch arm rests in a top, right-hand slot 1508, with the door stop positioned away from the door. The latch arm is raised from the slot, in FIG. 15B, to and rotated towards the door. In FIG. 15C, the latch arm is rotated 180° from the open position, and inserted into an upper left-hand slot 1510, securing the door stop 1506 against the door and preventing the door from being opened.

Figure 16B:
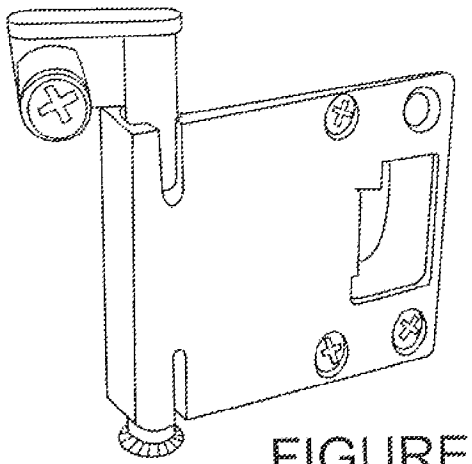
FIGS. 16A-C illustrate deployment of the security-latch embodiment of the present invention shown in FIGS. 15A-C.
Figure 16C:
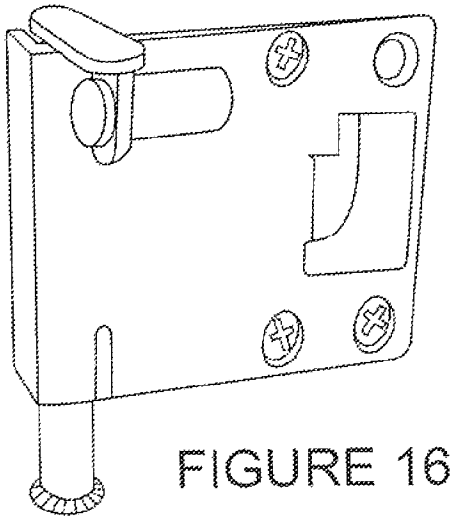
Figure 16A:
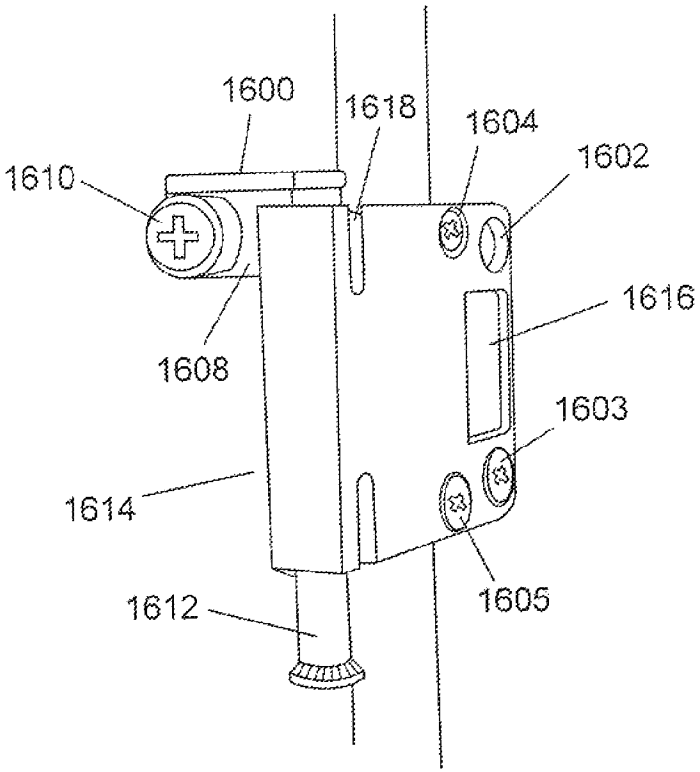

FIGS. 16A-C illustrate deployment of the security-latch embodiment of the present invention shown in FIGS. 15A-C. In FIGS. 16A-C, the security latch is mounted to the left of the door. Note that, because slots are included in both the top and bottom of the door-frame mount, the door-frame mount is reversible, and can be mounted to either side of the door. In FIG. 16A, the security latch is in an open position, with the latch arm 1600 resting in an upper left-hand slot. The door-frame mount is mounted to the door frame by two or four screws mounted through two or all of four dimpled apertures 1602-1605. The latch arm includes a horizontal member 1608 to which the door stop 1610 is mounted and a cylindrical shaft 1612 that extends through the door-frame mount 1614. In FIG. 16A, it can easily be seen that the door-frame mount also serves as a striker plate, having a square aperture 1616 for the door-lever latch. In FIG. 16B, the latch arm has been raised and rotated, and, in FIG. 16C, the latch arm is rotated 180° with respect to its initial, open position shown in FIG. 16A and securely inserted into the right-hand, upper slot 1618. In that position, the door stop is secured against the door (not shown in FIGS. 16A-C), and prevents the door from being opened. In this regard, the third embodiment of the present invention differs from the first two embodiments, described above, in that the third embodiment of the present invention does not allow the door to be partially opened, when the security latch is deployed.

Figure 17B:
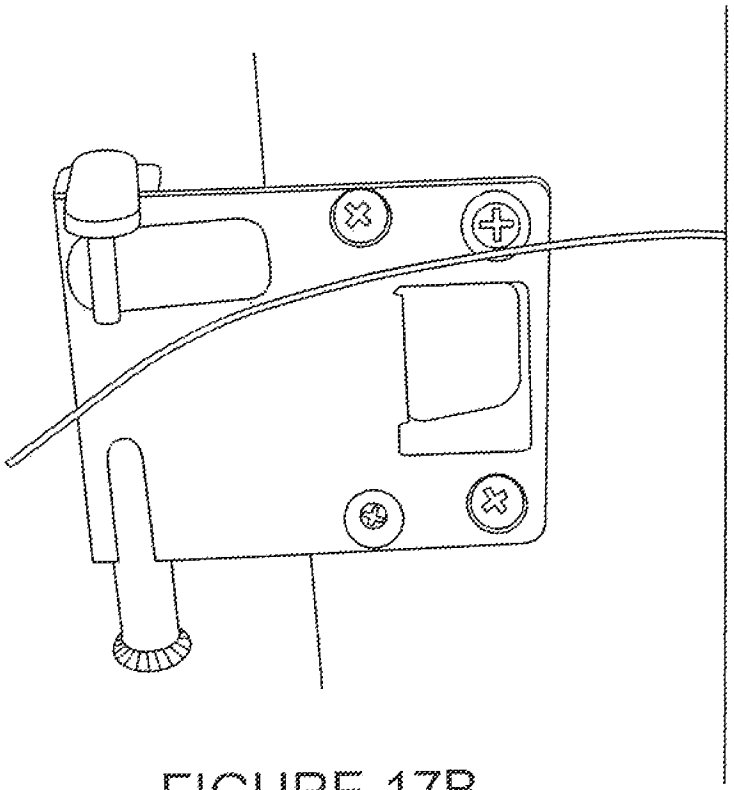
FIGS. 17A-D illustrate disabling of the security-latch embodiment of the present invention shown in FIGS. 15A-C from the external side of a door.
Figure 17A:
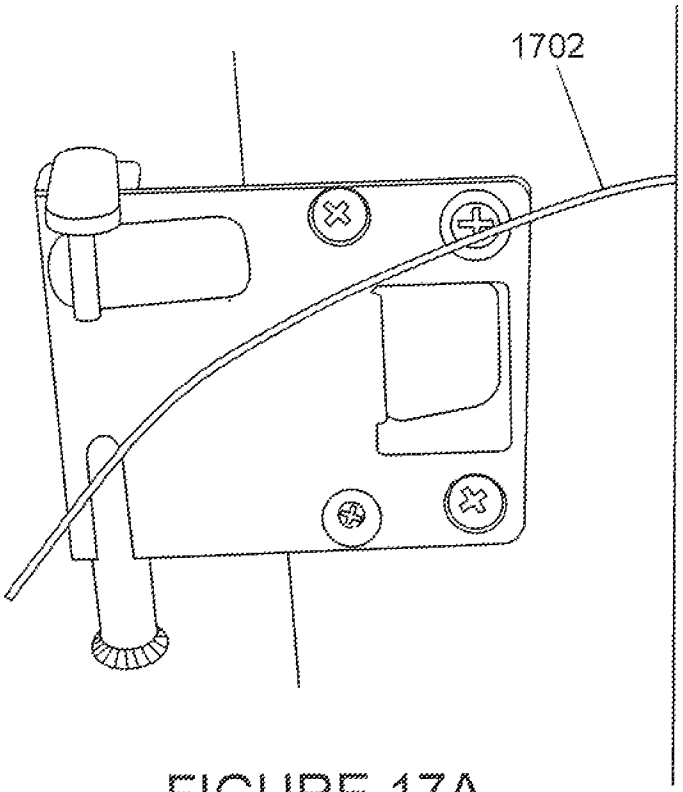
Figure 17D:
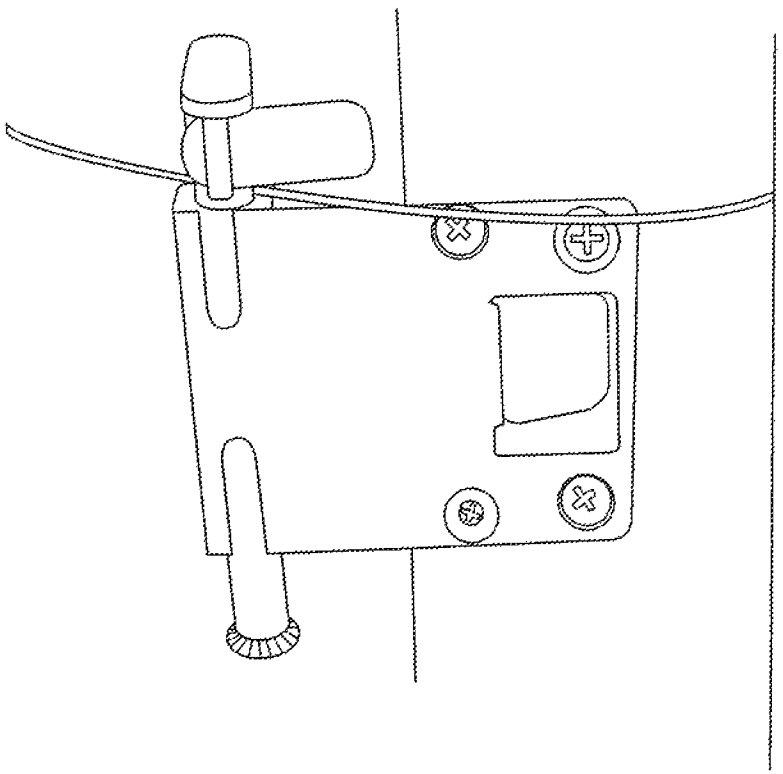
Figure 17C:
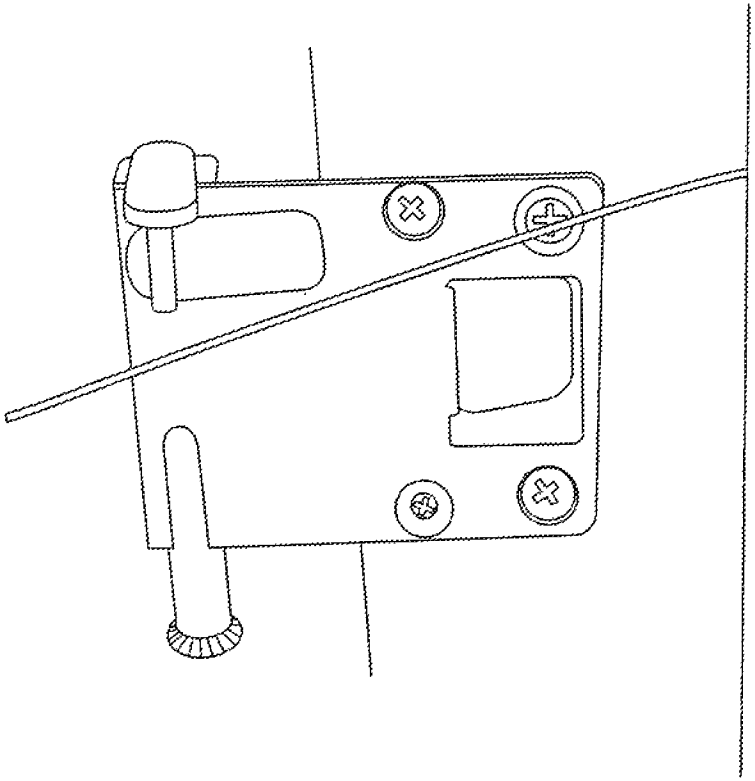

FIGS. 17A-D illustrate disabling of the security-latch embodiment of the present invention shown in FIGS. 15A-C from the external side of a door. The security latch does not allow the door to be even partially opened, and thus the security latch cannot be disabled by using a reciprocating saw inserted through a small opening, as is the case with the first two embodiments of the present invention. In order to disable the security latch shown in FIGS. 15A-16C, a small-diameter hole is drilled through the door frame, parallel to the door-frame mount and at the top of the door-frame mount. A memory-shape wire 1702 is then inserted through the hole, as shown in FIG. 17A. The memory-shape wire is curved, and the curved memory-shape wire is inserted, initially, with the interior end of the memory-shape wire curved downward. Next, as shown in FIGS. 17B-D, the memory-shape wire is rotated by 180°, catching the underside of the horizontal member of the latch arm and raising it out of the slot in the door-frame mount. In FIG. 17D, the security latch is disabled. The door can be pushed inward, rotating the latch arm inward as the door opens.

Figure 18A:
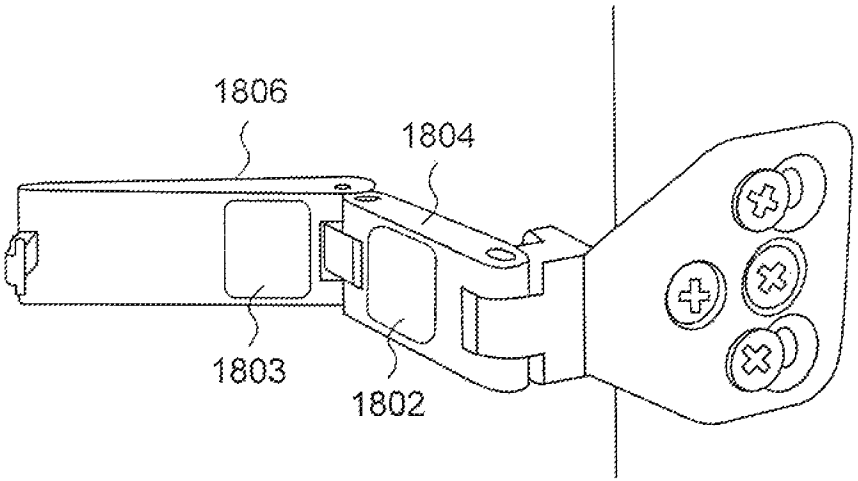
FIGS. 18A-D illustrate an additional, magnet-enhanced embodiment of the present invention based on the first set of embodiments of the present invention illustrated in FIGS. 5A-E and 6A-E.

FIGS. 18A-D illustrate an additional, magnet-enhanced embodiment of the present invention based on the first set of embodiments of the present invention illustrated in FIGS. 5A-E and 6A-E. In this additional embodiment of the present invention, as shown in FIG. 18A, a pair of magnets 1802 and 1803 are mounted within the first articulated latch-arm segment and second articulated latch-arm segment, respectively. In one embodiment of the present invention, both magnets are N-52 magnets. Many different types of permanent magnets may be used for the security-latch embodiments of the present invention, including various types of high-field-strength permanent magnets, such as rare-earth magnets, including neodymium, iron, boron ("NdFeB") magnets, may be suitable for the magnet-enhanced embodiments of the present invention. The magnets attract one another, when the articulated latch arm is folded onto itself, as in FIG. 6E, to hold the two articulated latch-arm segments together in order to prevent the security latch from adopting certain intermediate positions that may result from opening the door when the latch pin has not been pushed back towards the edge of the door and the edge of the latch-pin track, as it has in FIG. 6E. Attraction between the magnets cause the articulated latch arm to adopt the position shown in FIG. 6E as soon as the latch pin is inserted into the latch-pin track. The magnets 1802-1803 may be secured within the articulated latch-arm segments 1804 and 1806 by various fastening means, including frictional forces resulting from mechanically forcing the magnets into a tight-fitting, complementary aperture in the latch-arm segments, by using any of a variety of different mechanical ridges, pins, tabs, by shaping the apertures into which the magnets are inserted to produce forces that hold the magnets in place following insertion of the magnets, by using other fastening means, including screws, by various cements and glues, or by using other fastening means.

Figure 18B:
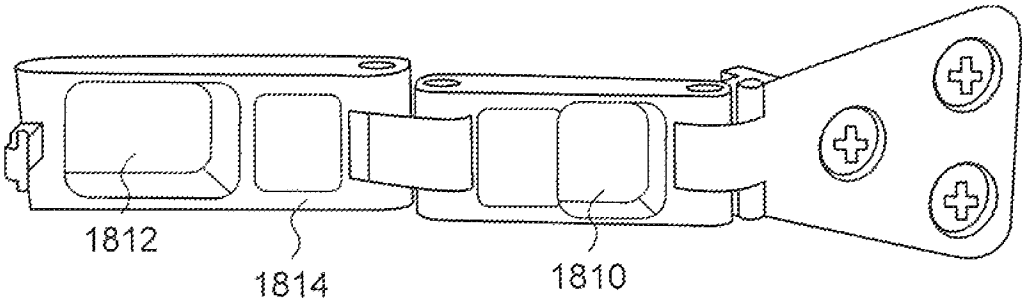

The articulated latch arm can be further improved, as shown in FIG. 18B, by hollowing out portions 1810 and 1812 of the articulated latch-arm segments from the underside of the articulated latch arm 1814. The well-like chambers 1810 and 1812 from which material is removed do not, in one embodiment of the present invention, extend through to the upper surface of the articulated latch arm, but instead, a thin layer of the articulated-latch-arm material is left at the bottom of the wells so that the appearance of the upper surface of the articulated latch arm, as shown in FIG. 6D, remains unchanged. Removal of articulated-latch-arm material from the articulated-latch-arm segments decreases the mass of the articulated-latch-arm segments, therefore facilitating the articulated-latch-arm folding effects of the two magnets to draw the articulated latch arm into the position shown in FIG. 6E. In addition, the first well 1810 provides a region of the first articulated-latch-arm segment that can be more readily cut, using bolt cutters, in order to disarm the security latch in order to respond to emergencies.

Figure 18D:
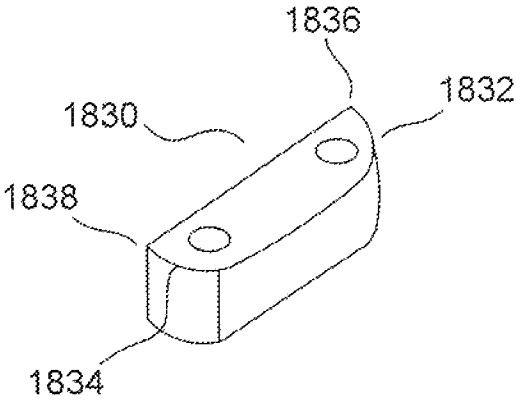
Figure 18C:
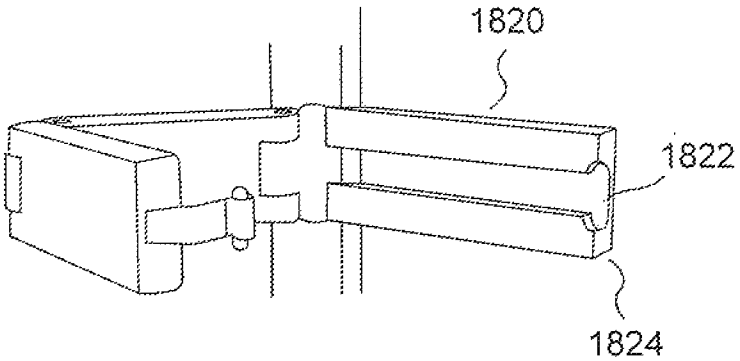

In one embodiment of the present invention, the link that joins the two articulated-link-arm segments (538 in FIG. 5A) is shaped as shown in FIG. 18D. The link 1830 has rounded edges 1832 and 1834 facing towards the inward side of the articulated latch arm (814 in FIG. 18B) and squared edges 1836 and 1838 facing towards the outer surface of the articulated latch arm. By shaping the link in this fashion, the articulated segment arm cannot be folded backward, from the extended position shown in FIG. 18B, so that the outer surfaces of the articulated-latch-arm segments approach one another, but can only be folded inward, as shown in FIGS. 18A and 18C. In certain embodiments of the magnet-enhanced security latch that represent embodiments of the present invention, a ferromagnetic or magnet piece or plate may be fastened to the door frame in order to magnetically secure the articulated latch arm, in an extended position but rotated so the upper side of the articulated latch arm resets against the ferromagnetic or magnet piece or plate when the articulated latch arm is not deployed.

Figure 6E:
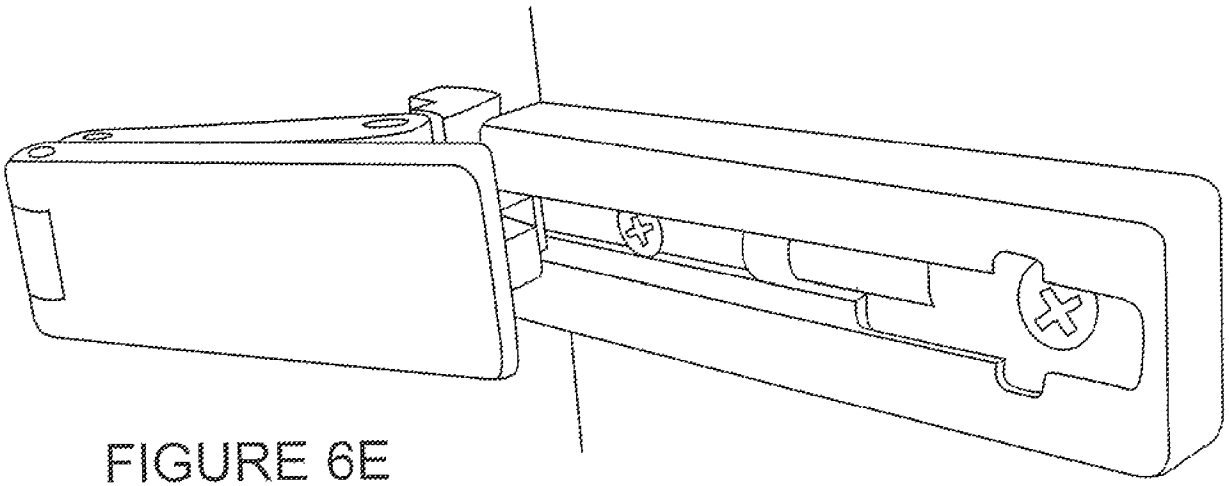

In yet an additional alteration of the security latch first described in FIGS. 5A-E and 6A-E, as shown in FIG. 18C, the latch-pin track 1820 is simplified by removing the depression (614 in FIG. 6B) baffle (608 in FIG. 6B) and deflector (610 in FIG. 6B), instead providing only a single, smooth track 1822 along which the latch pin moves as the security latch is folded toward the position shown in FIG. 6E. In alternative embodiments, the latch-pin aperture (562 in FIG. 5B) is placed as close as possible to the far edge 1824 of the latch-pin track, or, in additional embodiments, is placed at the end of the latch-pin track, so that the latch pin can be mounted either through the top surface and latch-pin aperture, or through the side of the latch-pin track.

Figure 19A:
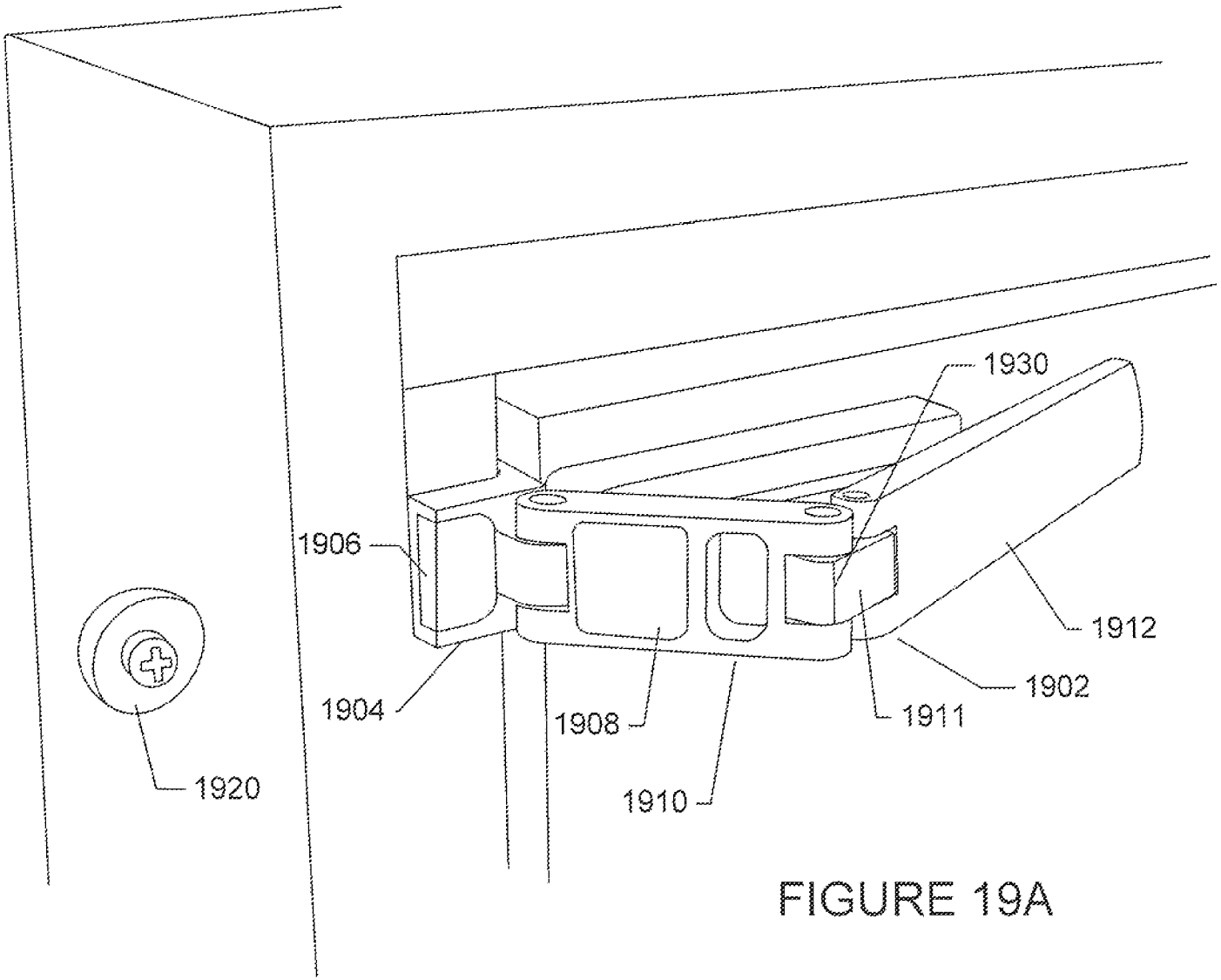
FIGS. 19A-D illustrate an additional embodiment of the present invention.
Figure 19B:
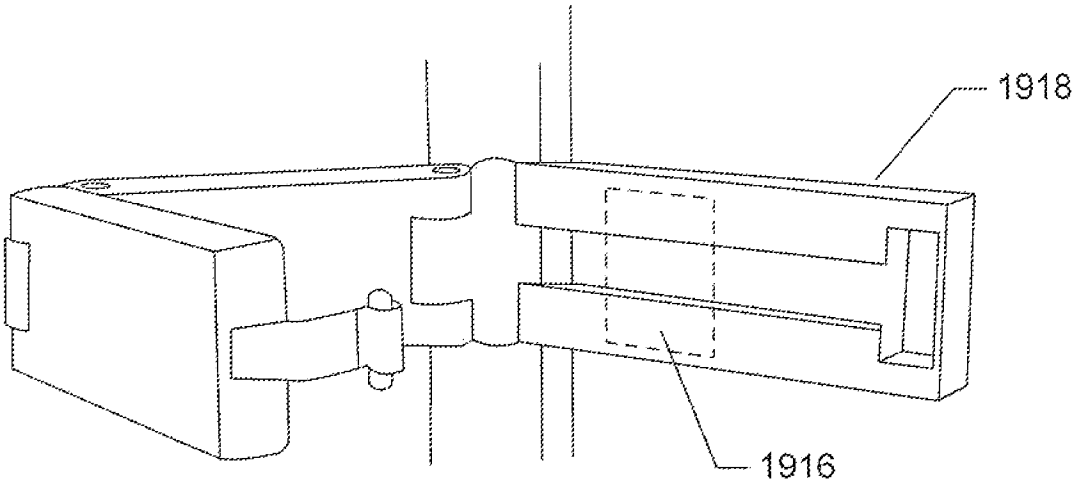
Figure 19C:
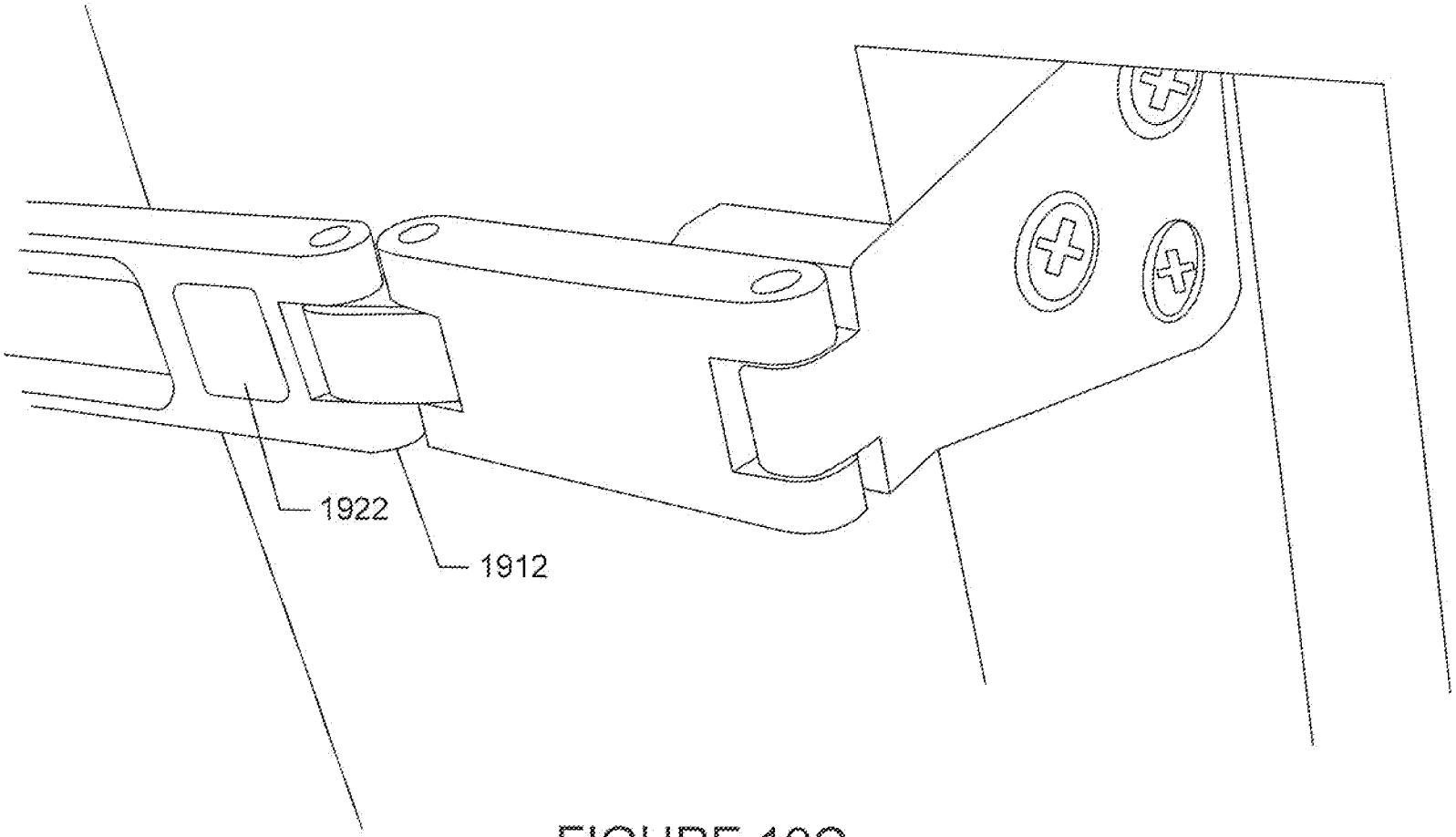
Figure 19D:
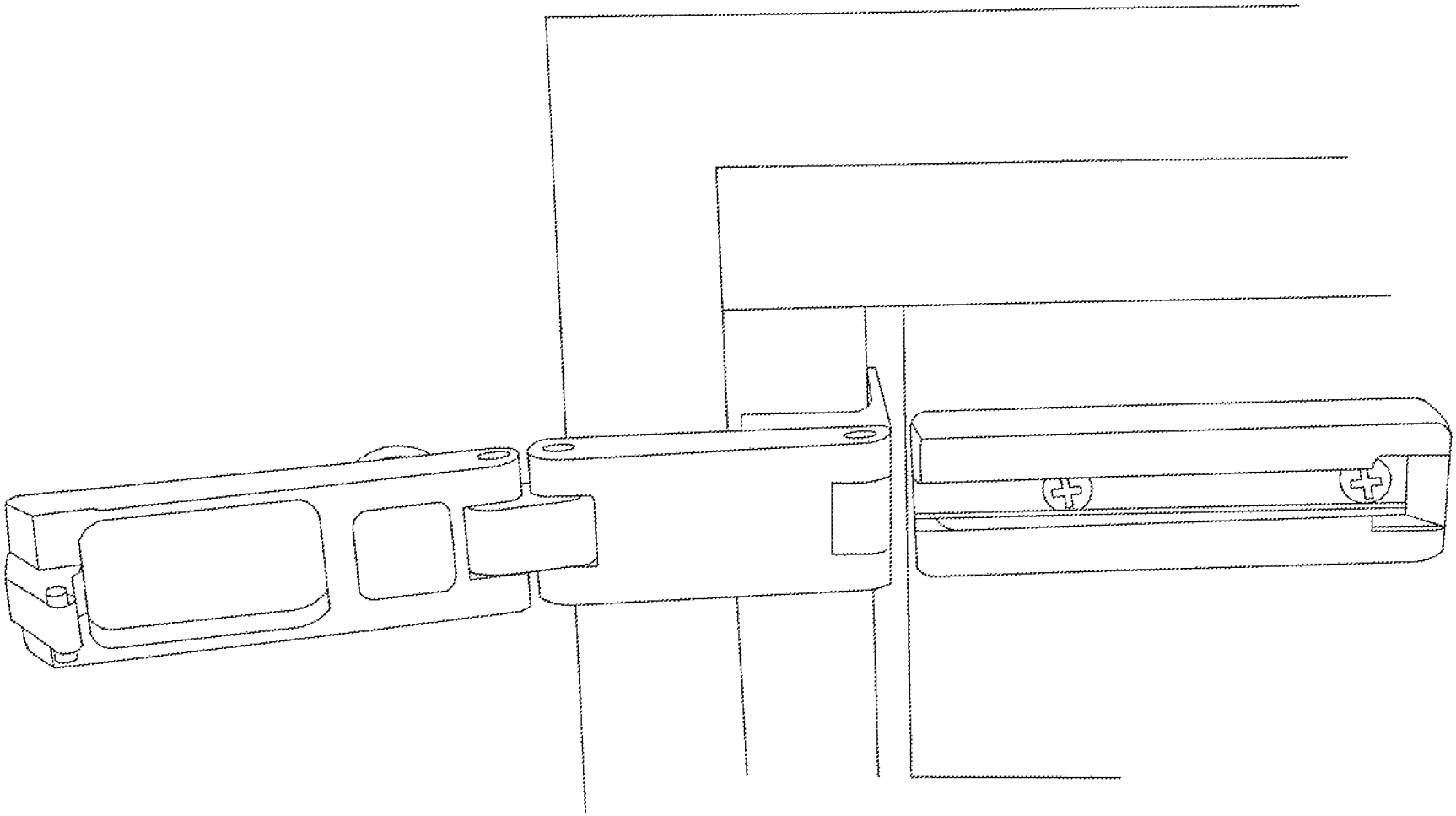

FIGS. 19A-D illustrate an additional embodiment of the present invention. In this embodiment, magnets are positioned differently, and additional magnets are employed, so that the security latch can be easily set and disabled with simple operations, and so that the security latch cannot be unintentionally partially deployed. As shown in FIG. 19, the security latch 1902 includes a flange/spacer with an first embedded magnet 1906 that is oriented so attract, or pull, a second embedded magnet 1908 in the second articulated-latch-arm segment 1910. The mutual attraction of the first and second embedded magnets acts as a return force to draw the first articulated-latch-arm segment 1912, the link 1911, and the second articulated-latch-arm segment 1910 back towards the door frame, either during latching or unlatching operations. As shown in FIG. 19B, a third magnet 1916, shown by a dashed outline in FIG. 19B, is embedded underneath the latch-pin track 1918, and has opposite polarity from the second embedded magnet 1908 to push or repel the second embedded magnet away and back toward the door frame, to add an additional force to the force of attraction between the first and second embedded magnets (1904 and 1908 in FIG. 19A). In addition, a fourth magnet, 1920 in FIG. 19A, is mounted to the door frame, and attracts a fifth, embedded magnet 1922 in FIG. 19C mounted in the first articulated-latch-arm segment 1912 to securely hold the first articulated-latch-arm segment 1912, the link 1911, and the second articulated-latch-arm segment 1910 against the door frame in an undeployed position. This prevents the security latch from residing in an intermediate position that can interfere with door opening and door closing. Moreover, the concerted actions of the magnets snap the security latch into this undeployed position as soon as the latch pin is disengaged from the latch-pin track, essentially making the unlatch operation a smooth, single-action operation. Similarly, when the latch pin is inserted into the latch-pin track, the concerted action of the magnets immediately draws the first articulated-latch-arm segment 1912, the link 1911, and the second articulated-latch-arm segment 1910 back towards the door frame, with embedded magnets 1904 and 1908 mating as the first articulated-latch-arm segment 1912 folds onto the second articulated-latch-arm segment 1910. In certain embodiments of the present invention, the link 1911 is modified by rounding edge 1930 or another edge to allow the first articulated-latch-arm segment 1912 to pivot back out of plane with the second articulated-latch-arm segment, to facilitate attraction and mating of the fifth, embedded magnet 1922 with the fourth magnet 1920. FIG. 19D shows the security latch in the undeployed position, with the first articulated-latch-arm segment 1912, the link 1911, and the second articulated-latch-arm segment 1910 securely held against the door frame by attraction between the magnet pairs 1904/1908 and 1920/1922.

Figure 20:
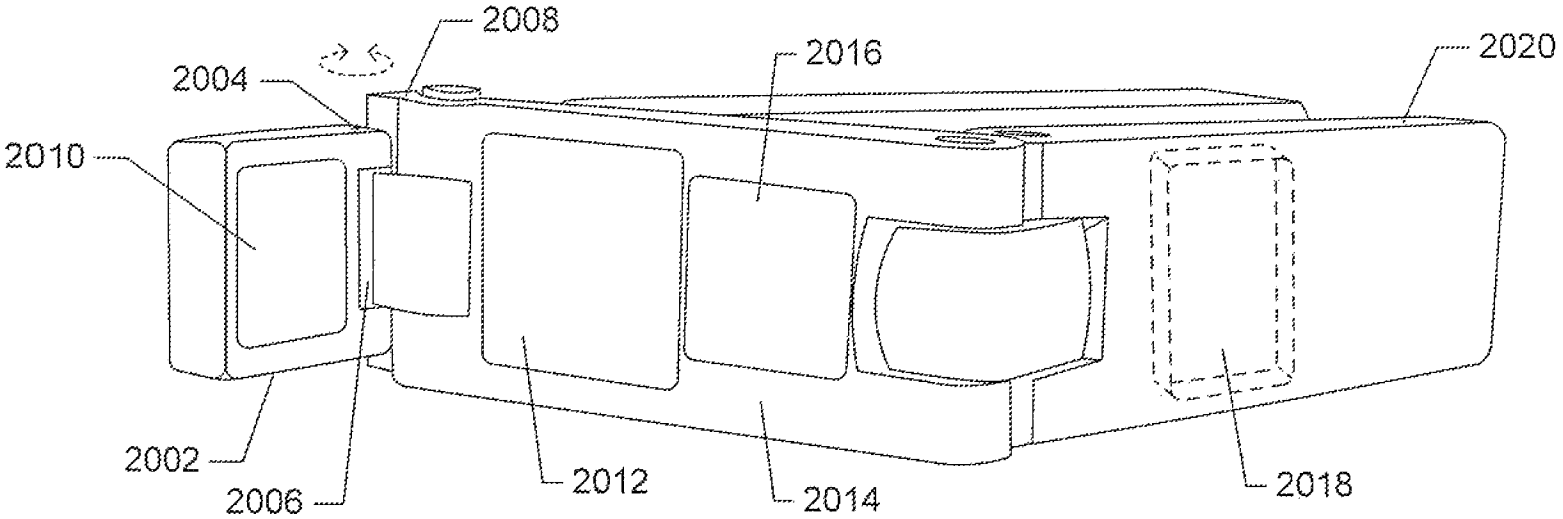
FIGS. 20-22 illustrate a bi-stable-magnetic-security-latch embodiment of the present invention.
Figure 21:
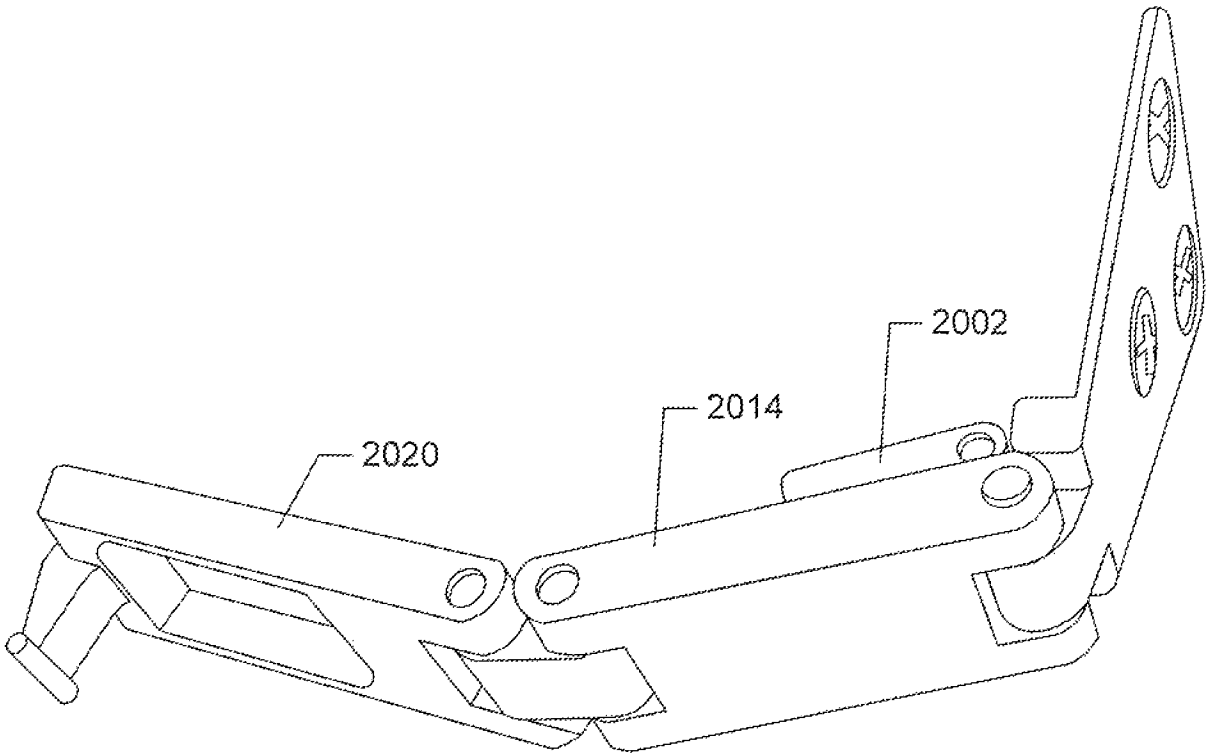
Figure 22:
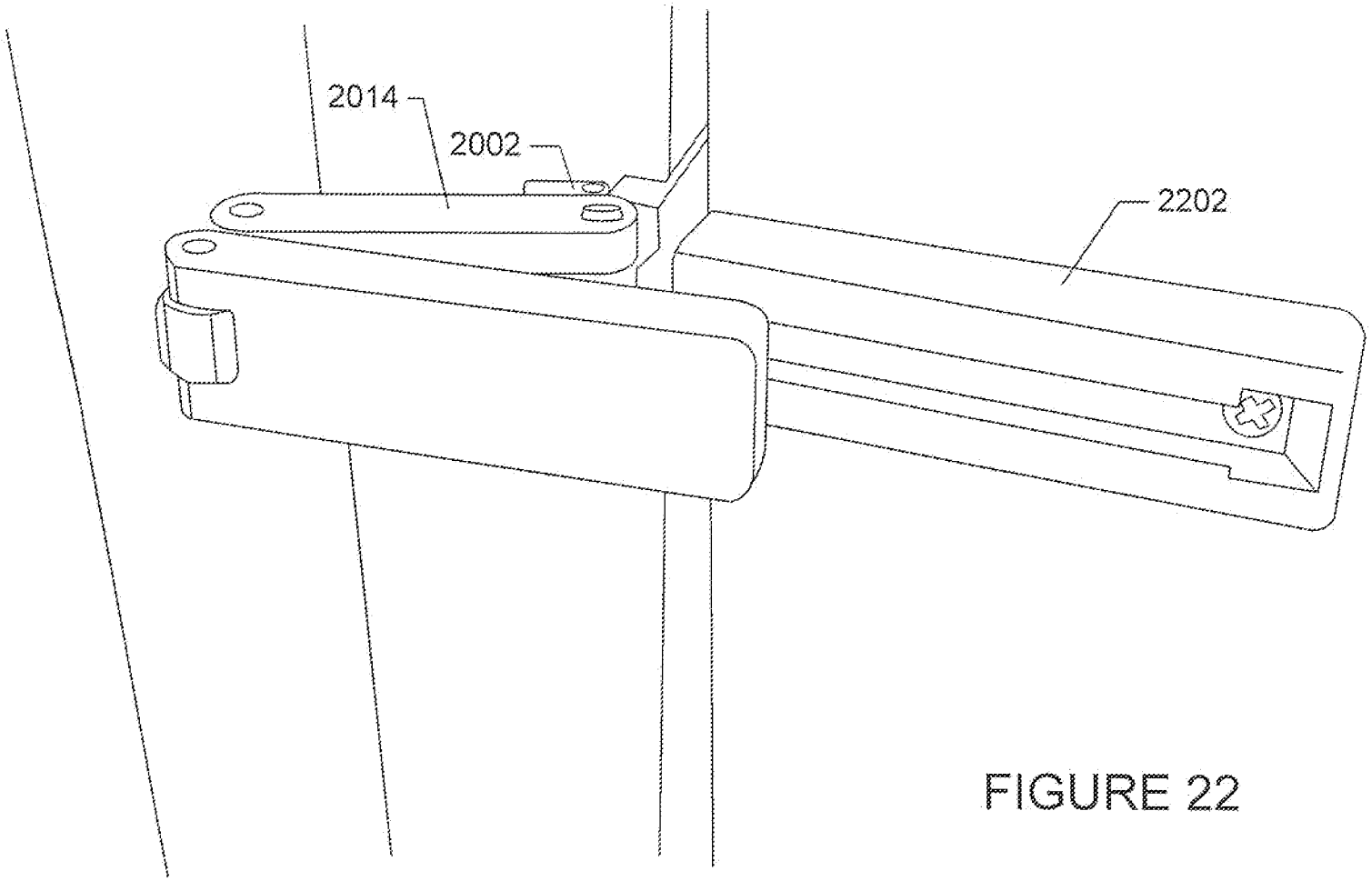

FIGS. 20-22 illustrate a bi-stable-magnetic-security-latch embodiment of the present invention. The bi-stable-magnetic-security-latch embodiment of the present invention is similar to the embodiments of the present invention discussed above with reference to FIGS. 5A-&c, 18A-D, and 19A-D. Much of the terminology used to describe the components of those embodiments of the present invention carry forward to describing the components of the bi-stable-magnetic security latch. In the bi-stable-magnetic-security-latch, a self-adjusting magnetic return is employed to pull the articulated-latch arm back, toward the doorframe, either when the articulated-latch arm is unlatched from the latch-pin track or when the latch pin is inserted into the latch-pin track and the security latch is deployed to latch a door. FIG. 20 shows the additional embodiment of the present invention in a position in which the articulated-latch-arm is positioned with the latch pin above the latch-pin track, from which position the security latch can either be latched or unlatched. The self-adjusting magnetic return 2002 is mounted, via a vertical pin 2004, to the tenon arm 2006 of a door-mount flange 2008 to allow the self-adjusting magnetic return 2002 to rotate through a small angle about the vertical pin. The self-adjusting magnetic return 2002 includes a first magnet 2010 aligned to attract a second magnet 2012 mounted within the first articulated-arm segment 2014. A third, similarly oriented magnet 2016 mounted within the first articulated-arm segment repels a fourth magnet 2018 mounted within the second articulated-latch-arm segment 2020 when the second articulated-latch-arm segment 2020 is folded inward so that the back side (obscured in FIG. 20) of the second articulated-latch-arm segment approaches the back side (obscured in FIG. 20) of the first articulated-arm segment 2014.

FIG. 21 shows the articulated-latch arm and door-frame mount of the bi-stable-magnetic-security-latch embodiment of the present invention in an unlatched, extended position. The articulated-latch arm, comprising the first articulated-arm segment and second articulated-arm segment 2020 automatically and quickly adopts the extended position shown in FIG. 21 when the articulated-latch arm is released by a user in the position shown in FIG. 20. The third magnet (2016 in FIG. 20) repels the fourth magnet (2018 in FIG. 20) in the second articulated-arm segment 2020 to prevent the second articulated-arm segment from folding onto the first articulated-arm segment while the first magnet (2010 in FIG. 20) in the self-adjusting magnetic return 2002 attracts the second magnet (2012 in FIG. 20) in the first articulated-arm segment 2014, so that the first articulated-arm segment ends up resting against the self-adjusting magnetic return 2002. Thus, whenever the articulated-latch arm is not grasped or held by a user, the articulated-latch arm automatically and quickly positions itself back against the door frame, in the extended position shown in FIG. 21, so that the security latch cannot adopt any intermediate positions that would interfere with opening and closing of the door or create other problems.

FIG. 22 shows the security latch of the bi-stable-magnetic-security-latch embodiment of the present invention in a latched position. The security latch quickly and automatically adopts the deployed position shown in FIG. 22 when the latch pin is inserted into the latch-pin track 2202, by pushing the second articulated-latch-arm segment forward, from the position shown in FIG. 20, and released. The first magnet (2010 in FIG. 20) in the self-adjusting magnetic return 2002 attracts the second magnet (2012 in FIG. 20) in the first articulated-arm segment 2014, so that the first articulated-arm segment ends up resting against the self-adjusting magnetic return 2002. This attractive force overcomes the repelling force between the third magnet (2016 in FIG. 20) in the first articulated-latch-arm segment and the fourth magnet (2018 in FIG. 20) in the second articulated-arm segment to draw the articulated-latch arm into the deployed position shown in FIG. 22.

The embodiment of the present invention shown in FIGS. 20-22 is referred to as the "bi-stable magnetic security latch" because the security latch, when not held or grasped by a user, automatically adopts either the undeployed, extended position shown in FIG. 21 or the deployed position in FIG. 22. These are the only two positions that the bi-stable-magnetic security latch can adopt, unless physically held and manipulated by a user. The bi-stable-magnetic security latch features only two stable positions, and thus cannot adopt a stable intermediate position that would interfere with opening and closing the door, or cause other problems.

The self-adjusting magnetic return 2002 provides rotational flexibility that allows for easy mounting of the bi-stable-magnetic security latch to doors with various types of door-frame moldings. The self-adjusting magnetic return can rotate forward, through a small angle, to accommodate thicker moldings. In addition, the latch-arm articulations provide a certain degree of tolerance with respect to vertical misalignment of the door-frame mount and articulate-latch arm with the latch-pin track, in case of shifting of the position of the door with respect to the door frame. The bi-stable-magnetic security latch may additionally include a fifth magnet embed in, or located behind, the latch-pin track, as in the previously described embodiment shown in FIGS. 19A-D. In an alternative embodiment of the bi-stable-magnetic security latch, the second and third magnets within the first articulated-latch-arm segment may be combined as a single second magnet.

Although the present invention has been described in terms of a particular embodiment, it is not intended that the invention be limited to this embodiment. Modifications within the spirit of the invention will be apparent to those skilled in the art. For example, the security latches are commonly fabricated from metal and, in the case of the third embodiment of the present invention, shown in FIGS. 15A-17D, include a door stop made from, or coated with, plastic or another polymeric material. However, any of various other suitable materials can be used, including rigid plastics and composites. The latch arms, articulated latch-arm segments, pivot pins, links, and door-frame mounts can have various different dimensions and shapes, providing that they function as described above to securely latch a door. All of the embodiments of the present invention feature mounting with screws or other fasteners so that the shafts of the screws or other fasteners are approximately orthogonal to the direction of a force needed to open the door, so that the security latches of the present invention cannot be easily disabled by applying sufficient force to dislodge screws from the substrate in which they are mounted and so that the inner door and door frame surfaces are not defaced during installation. All of the latches of the present invention are easily and intuitively operated, so that a panicked or confused room occupant is not delayed in fleeing a fire or other emergency. The latches move only in well defined directions. The latch arm of the security latch described with reference to FIGS. 5A-7C moves only in a horizontal plane. The latch arms of the security latches described with reference to FIGS. 12A-14C and FIGS. 15A-17D moves only in a horizontal plane and vertically. These limited degrees of freedom in motion facilitate ease of use, and also contribute to the strength and robustness of the security latches. The security latches of the present invention are mechanically stronger than currently available door security latches, such as the door latch chain, described above with reference to FIGS. 2A-C. Although installation of various embodiments of the present invention do involve drilling pilot holes for screws and some milling or routing, the bulk of these modifications are made to the surface of the door frame parallel to the door edge, and are thus not generally visible. Furthermore, only one or two screw holes are needed, for the first and second embodiments of the present invention, to mount the latch-pin track or latch pin-and-guide assembly. Should the latch be removed, these holes can be easily filled. One or two holes are less likely to result in defacement to the door than four closely-spaced holes required by many currently available devices.

The foregoing description, for purposes of explanation, used specific nomenclature to provide a thorough understanding of the invention. However, it will be apparent to one skilled in the art that the specific details are not required in order to practice the invention. The foregoing descriptions of specific embodiments of the present invention are presented for purpose of illustration and description. They are not intended to be exhaustive or to limit the invention to the precise forms disclosed. Obviously many modifications and variations are possible in view of the above teachings. The embodiments are shown and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents:

The invention claimed is:

1. A bi-stable-magnetic latch comprising:

a latch that includes a door-frame mount having a flange with a first tenon arm and a second tenon arm, a magnetic return mounted to the first tenon arm, the magnetic return including a first magnet, an articulated-latch arm mounted to the second tenon arm, the articulated-latch arm including second, third, and fourth magnets, and a latch pin; and a latch-pin track that slideably retains the latch pin when the latch is deployed, the second, third, and fourth magnets holding the articulated-latch arm in an undeployed position when the latch pin is not retained in the latch-pin track.

2. The bi-stable-magnetic latch of claim 1 wherein:

the flange is a generally flat sheet, with dimpled apertures through which screws mount the door-frame mount to a door frame;

the magnetic return is mounted to the first tenon arm via a first pivot pin; and the articulated-latch arm is rotatably mounted to the second tenon arm.

3. The bi-stable-magnetic latch of claim 2 wherein the articulated latch arm comprises:

a first articulated-latch-arm segment including the second and third magnets;

a second articulated-latch-arm segment including the fourth magnet;

a link;

a second pivot pin that rotatably mounts the first articulated-latch-arm segment to the door-frame mount, the second pivot pin passing through an upper mortise arm and lower mortise arm at a first end of the first articulated-latch-arm segment and the second tenon arm extending from the door-frame mount;

a third pivot pin that rotatably mounts the first articulated-latch-arm segment to the link, the third pivot pin passing through an upper mortise arm and lower mortise arm at a second end of the first articulated-latch-arm segment; and a fourth pivot pin that rotatably mounts the second articulated-latch-arm segment to the link, the fourth pivot pin passing through an upper mortise arm and lower mortise arm at a first end of the second articulated-latch-arm segment; and wherein the latch pin is mounted to the second end of the second articulated-latch-arm segment.

4. The bi-stable-magnetic latch of claim 3 wherein the latch-pin track includes:

a rectangular groove that extends across the latch-pin track, the groove including one or more baffles that prevent unencumbered back-tracking of the latch pin along the groove; and a latch-pin aperture through which the latch pin is inserted during deployment of the bi-stable-magnetic latch.

5. The bi-stable-magnetic latch of claim 4 wherein the latch-pin track further includes a fifth magnet either within the latch-pin track or embedded behind the latch-pin track.

6. The bi-stable-magnetic latch of claim 5 wherein, in an undeployed position, the first articulated-latch-arm segment and the second articulated-latch-arm segment are securely held flat against the door frame by attraction between the first and second magnets and by repulsion between the third and fourth magnets.

7. The bi-stable-magnetic latch of claim 5 wherein, in a deployed position, the first articulated-latch-arm segment is folded on top of the second articulated-latch-arm segment, and both articulated segments are securely held flat against the door frame by attraction between the first and second magnets.

8. The bi-stable-magnetic latch of claim 1 wherein the bi-stable-magnetic latch can adopt one of only two stable positions that include an extended, undeployed position and a folded, latched position when the latch arm is not held, grasped, or otherwise manipulated by a user.

9. A bi-stable-magnetic latch comprising:

a latch that includes a door-frame mount having a flange with a first tenon arm and a second tenon arm, a magnetic return mounted to the first tenon arm, the magnetic return including a first magnet, an articulated-latch arm mounted to the second tenon arm that includes second and third magnets, and a latch pin; and a latch-pin track that slideably retains the latch pin when the latch is deployed, the second, third, and fourth magnets holding the articulated-latch arm in an undeployed position when the latch pin is not retained in the latch-pin track.

10. The bi-stable-magnetic latch of claim 9 wherein:

the flange is a generally flat sheet, with dimpled apertures through which screws mount the door-frame mount to a door frame;

the magnetic return is mounted to the first tenon arm via a first pivot pin; and the articulated-latch arm is rotatably mounted to the second tenon arm.

11. The bi-stable-magnetic latch of claim 10 wherein the articulated latch arm comprises:

a first articulated-latch-arm segment including the second magnet;

a second articulated-latch-arm segment including the third magnet;

a link;

a second pivot pin that rotatably mounts the first articulated-latch-arm segment to the door-frame mount, the second pivot pin passing through an upper mortise arm and lower mortise arm at a first end of the first articulated-latch-arm segment and the second tenon arm extending from the door-frame mount;

a third pivot pin that rotatably mounts the first articulated-latch-arm segment to the link, the third pivot pin passing through an upper mortise arm and lower mortise arm at a second end of the first articulated-latch-arm segment; and a fourth pivot pin that rotatably mounts the second articulated-latch-arm segment to the link, the fourth pivot pin passing through an upper mortise arm and lower mortise arm at a first end of the second articulated-latch-arm segment; and wherein the latch-pin is mounted to the second end of the second articulated-latch-arm segment.

12. The bi-stable-magnetic latch of claim 11 wherein the latch-pin track includes:

a rectangular groove that extends across the latch-pin track, the groove including one or more baffles that prevent unencumbered back-tracking of the latch pin along the groove; and a latch-pin aperture through which the latch pin is inserted during deployment of the bi-stable-magnetic latch.

13. The bi-stable-magnetic latch of claim 12 wherein the latch-pin track further includes a fourth magnet either within the latch-pin track or embedded behind the latch-pin track.

14. The bi-stable-magnetic latch of claim 12 wherein, in an undeployed position, the first articulated-latch-arm segment and the second articulated-latch-arm segment are securely held flat against the door frame by attraction between the first and second magnets and by repulsion between the second and fourth magnets.

15. The bi-stable-magnetic latch of claim 12 wherein, in a deployed position, the first articulated-latch-aim segment is folded on top of the second articulated-latch-arm segment, and both articulated segments are securely held flat against the door frame by attraction between the first and second magnets.

16. The bi-stable-magnetic latch of claim 9 wherein the bi-stable-magnetic latch can adopt one of only two stable positions that include an extended, undeployed position and a folded, latched position when the latch arm is not held, grasped, or otherwise manipulated by a user.

* * * * *